US005803193A

United States Patent [19]

Krueger et al.

[11] Patent Number: 5,803,193

[45] Date of Patent: Sep. 8, 1998

[54] DRILL PIPE/CASING PROTECTOR ASSEMBLY

[75] Inventors: R. Ernst Krueger, Newport Beach; N. Bruce Moore, Costa Mesa, both of Calif.

[73] Assignee: Western Well Tool, Inc., Houston, Tex.

[21] Appl. No.: 710,628

[22] Filed: Sep. 20, 1996

Related U.S. Application Data

[63] Continuation-in-part of Ser. No. 542,098, Oct. 12, 1995, abandoned.

[51] Int. Cl.[6] ..... E21B 17/10

[52] U.S. Cl. ..... 175/325.1; 166/241.6

[58] Field of Search ..... 166/241.1, 241.2, 166/241.3, 241.4, 241.5, 241.6; 175/65, 325.1

[56] References Cited

U.S. PATENT DOCUMENTS

| | | | |
|---|---|---|---|
| 2,308,316 | 1/1943 | Smith et al. | 308/4 |
| 2,318,878 | 5/1943 | Miller | 308/4 |
| 2,368,415 | 1/1945 | Grant | 308/4 |
| 2,388,416 | 11/1945 | Johnson | 166/4 |
| 2,715,552 | 8/1955 | Lane | 308/4 |
| 2,715,553 | 8/1955 | Ritter et al. | 308/36.1 |
| 2,860,013 | 11/1958 | Medearis | 308/4 |
| 2,966,121 | 12/1960 | Crowl | 103/202 |
| 3,063,759 | 11/1962 | Moore et al. | 308/4 |
| 3,088,532 | 5/1963 | Kellner | 175/230 |
| 3,320,004 | 5/1967 | Garrett | 308/4 |
| 3,397,017 | 8/1968 | Grant et al. | 308/4 |
| 3,410,613 | 11/1968 | Kuus | 308/4 |
| 3,528,499 | 9/1970 | Collett | 166/175 |
| 3,560,060 | 2/1971 | Morris | 308/4 |
| 3,963,075 | 6/1976 | Evans | 166/241 |
| 3,999,811 | 12/1976 | Gray | 308/4 |
| 4,071,101 | 1/1978 | Ford | 175/325 |
| 4,083,612 | 4/1978 | Olson | 308/4 |
| 4,099,564 | 7/1978 | Hutchinson | 166/241 |
| 4,787,448 | 11/1988 | Sable | 166/176 |
| 4,796,670 | 1/1989 | Russell et al. | 138/110 |
| 4,907,661 | 3/1990 | Lloyd | 175/325 |
| 5,069,297 | 12/1991 | Krueger et al. | 175/65 |
| 5,247,990 | 9/1993 | Sudol et al. | 166/241.3 |

FOREIGN PATENT DOCUMENTS

| | | |
|---|---|---|
| 1157044 | 7/1969 | United Kingdom . |
| 1173202 | 12/1969 | United Kingdom . |
| 2204895 | 11/1988 | United Kingdom . |
| WO9510685 | 4/1995 | WIPO . |

*Primary Examiner*—Frank Tsay
*Attorney, Agent, or Firm*—Christie, Parker & Hale, LLP

[57] ABSTRACT

A drill pipe/casing protector assembly for an underground drilling system comprises a well bore in an underground formation, a fixed tubular casing installed in the well bore, a rotary drill pipe extending through the casing and having an O.D. spaced from an I.D. of the casing (or well bore) during normal drilling operations, and a protective sleeve mounted around the drill pipe and spaced from the I.D. of the casing, and upper and lower thrust bearings affixed to the drill pipe above and below the sleeve to retain the sleeve in a fixed axial position on the drill pipe. The sleeve contacts the I.D. of the casing when the drill pipe deflects off-center to protect the casing from contact with the drill pipe or its tool joints during rotation of the drill pipe. Axial grooves in an I.D. wall of the sleeve allow fluid under pressure to circulate through a space formed between the I.D. of the sleeve and the O.D. of the drill pipe. Generally flat bearing surface regions on the I.D. wall of the sleeve between adjacent grooves are arranged in a polygon configuration for tangentially contacting the O.D. of the drill pipe around the sleeve I.D. The sleeve separates from the O.D. of the drill pipe upon circulation of a fluid film under pressure between the sleeve and drill pipe to produce a fluid bearing effect with reduced frictional drag. End slots at the top and bottom annular end walls of the sleeve provide enhanced fluid bearing effects in the clearance regions between the sleeve and the adjacent thrust bearings.

38 Claims, 14 Drawing Sheets

18
20
10
18
20
14
12
18
20
12
16
18
20
18
20
15

DRILL PIPE/CASING PROTECTOR ASSEMBLY

RELATED APPLICATIONS

This is a continuation-in-part of Ser. No. 08/542,098 filed Oct. 12, 1995 now abandoned.

FIELD OF THE INVENTION

This invention relates generally to drill pipe/casing protectors, and more particularly, to a drill pipe/casing protector assembly that reduces the torque experienced by a rotating drill pipe when the attached protector comes into contact with a well casing or with the wall of a formation being drilled.

BACKGROUND OF THE INVENTION

In the drilling of oil and gas wells, a drill bit attached to the bottom of a drill string bores a hole into an underground formation. A drill string typically comprises a long string of connected tubular drill pipe sections that extend from the surface into a well bore formed by the drill bit on the bottom of the drill string. Casing is typically installed from the surface to various depths throughout the well bore to prevent the wall of the well bore from caving in; to prevent the transfer of fluids from various drilled formations from entering the well bore, and vice versa; and to provide a means for recovering petroleum if the well is found to be productive.

During rotary drilling operations the drill pipe is subjected to shock and abrasion whenever the drill pipe comes into contact with the wall of the well bore or the casing. In many drilling operations, the drill pipe may extend underground along a curved path, such as in deviated well drilling, and in these instances a considerable amount of torque can be produced by the effects of frictional forces developed between the rotating drill pipe and the casing or the wall of the well bore.

In the past, drill pipe protectors have been placed in different locations along the length of a drill pipe to keep the drill pipe and its connections away from the walls of the casing and/or formation. These drill pipe protectors typically have been made from metal or composites, rubber or other elastomeric materials because of their ability to absorb shock and impart minimal wear. In more recent years drill pipe protectors have been made from low coefficient of friction rubber or polymeric materials. Typical prior art drill pipe protectors have an outside diameter (O.D.) greater than that of the drill pipe tool joints, and these protectors in the past were installed or clamped rigidly onto the O.D. of the drill pipe at a point near the tool joint connections of each length of drill pipe. The O.D. is specifically sized to be larger than the tool joint, but not too large as to restrict returning fluids which could result in "pistoning" of the protector in the hole. Such an installation allows the protector only to rub against the inside wall of the casing as the drill pipe rotates. Although wear protection for the casing is the paramount objective when using such drill pipe protectors, they can produce a significant increase in the rotary torque developed during drilling operations. In instances where there may be hundreds of these protectors in the well bore at any one time. These prior protectors can generate sufficient accumulative torque or drag to adversely affect drilling operations if the power required to rotate the drill pipe approaches or exceeds the supply power available.

In response to the problems of wear protection and torque build up, improvements have been directed toward producing drill pipe/casing protectors from various low coefficient of friction materials in different configurations. However, such an approach again has only been marginally effective, and oil companies still are in need of an effective means to greatly reduce the wear and frictionally-developed torque normally experienced particularly when drilling deeper wells and deviated wells.

U.S. Pat. No. 5,069,297 to Krueger, et al., assigned to the assignee of the present application, and incorporated herein by reference, discloses a drill pipe/casing protector assembly which has successfully addressed the problems of providing wear protection for the casing and reducing torque built up during drilling operations. The protector sleeve in the '297 patent rotates with the drill pipe during normal operations in which there is an absence of contact between the protector sleeve and the casing, but the protector sleeve stops rotating, or rotates very slowly, while allowing the drill pipe to continue rotating within the sleeve unabated upon frictional contact between the sleeve and the casing. Thrust bearings are rigidly affixed to the drill pipe at opposite ends of the protector sleeve leaving space between the collars and sleeve ends, and these, in combination with the internal configuration of the protector sleeve, produce a fluid bearing effect in the space between the inside of the sleeve and the outside of the drill pipe. The fluid bearing effect is produced by circulating drilling fluid through the space between the sleeve and the drill pipe so that it reduces frictional drag between the rotating drill pipe and the sleeve when the sleeve stops rotating from contact with the casing.

The present invention provides improvements upon the drill pipe/casing protector disclosed in the '297 patent by providing an enhanced fluid bearing effect that ensures reduced frictional drag between the rotating drill pipe and the protector sleeve during use. Other improvements in reducing wear on the protector sleeve and on the drill pipe as well as improvements in reducing sliding friction of the drill pipe/protector combination during use also are disclosed.

SUMMARY OF THE INVENTION

Briefly, one embodiment of this invention comprises a drill pipe/casing protector assembly for an underground drilling system comprising a well bore in an underground formation, a fixed tubular casing installed in the well bore, a rotary drill pipe extending through the casing and having an O.D. spaced from an I.D. of the casing or well bore during normal drilling operations, and a protective sleeve installed around the drill pipe and spaced from the I.D. of the casing or bore. Upper and lower thrust bearings are affixed to the drill pipe above and below the protector sleeve for retaining the sleeve in a fixed axial position on the drill pipe. During use, the protector sleeve preferentially contacts the I.D. of the casing or bore when the drill pipe deflects off-center in the casing or bore to protect the casing or bore from contact with the drill pipe or its tool joints during rotation or sliding of the drill pipe. The protective sleeve is mounted to the drill pipe in a configuration that substantially reduces the rotational rate of the sleeve upon frictional contact of the sleeve with the I.D. of the casing or bore, while allowing the rotary drill pipe to continue rotating within the sleeve at a rotation rate sufficient to continue conducting drilling operations in the formation. In one embodiment, longitudinally extending and circumferentially spaced apart grooves are formed in an I.D. wall of the sleeve for allowing fluid under pressure to circulate through a space formed between the I.D. of the sleeve and the O.D. of the drill pipe, when the protector sleeve contacts the casing or bore. Generally flat bearing surface regions of the I.D. wall of the sleeve between adjacent grooves are arranged in a polygon configuration contacting the O.D. of the drill pipe by tangential point contact around the sleeve I.D. when the protector sleeve is under side loads. This polygon/tangential contact in conjunction with the intervening axial grooves causes the protector sleeve to separate from the rotating O.D. of the drill pipe upon circulation of a fluid film under pressure between the sleeve I.D. and drill pipe O.D. to produce a fluid bearing effect that reduces rotating frictional drag during use.

In one form of the invention, the protective sleeve has circumferentially spaced apart and axially extending flutes on the O.D. of the sleeve communicating at their top and bottom with circumferentially spaced apart end slots on the top and bottom annular ends of the protector sleeve. These end slots provide flow channels for communicating fluid pressure to the interior regions of the protector sleeve near the thrust bearings to produce a further fluid bearing effect at the ends of the protector sleeve. This enhanced fluid bearing effect contributes to reduced frictional drag during use.

In a preferred embodiment, the number of polygon sides of the flat bearing wall surfaces around the protector sleeve I.D. is related to their capability of reducing frictional drag (reduced coefficient of friction) during use. In one embodiment in which a five-inch I.D. protector sleeve is used, for example, the coefficient of friction is lowest with a sleeve I.D. having a polygon configuration with about 10 to 13 flat bearing wall surfaces, preferably 12 bearing wall surfaces. In another example in which a six-inch I.D. protector sleeve is used, the coefficient of friction is lowest when the sleeve I.D. has a polygon configuration with 14 or 15 flat bearing wall surfaces.

In a further embodiment of the I.D. configuration of protector sleeve, transitional regions between the ends of the flat polygon bearing surfaces and the axial grooves at opposite ends of each flat bearing surface are arcuately curved with a first radius of curvature that forms the bearing surface and transitioning into a second reverse radius of curvature leading to the groove. The first radius of curvature is greater than the second radius of curvature. This arrangement can provide for enhanced fluid bearing effects when the drill pipe is rotating inside the protective sleeve and the sleeve stops rotating upon contact with the casing or well bore.

These and other aspects of the invention will be more fully understood by referring to the following detailed description and the accompanying drawings.

DETAILED DESCRIPTION

Figure 1:
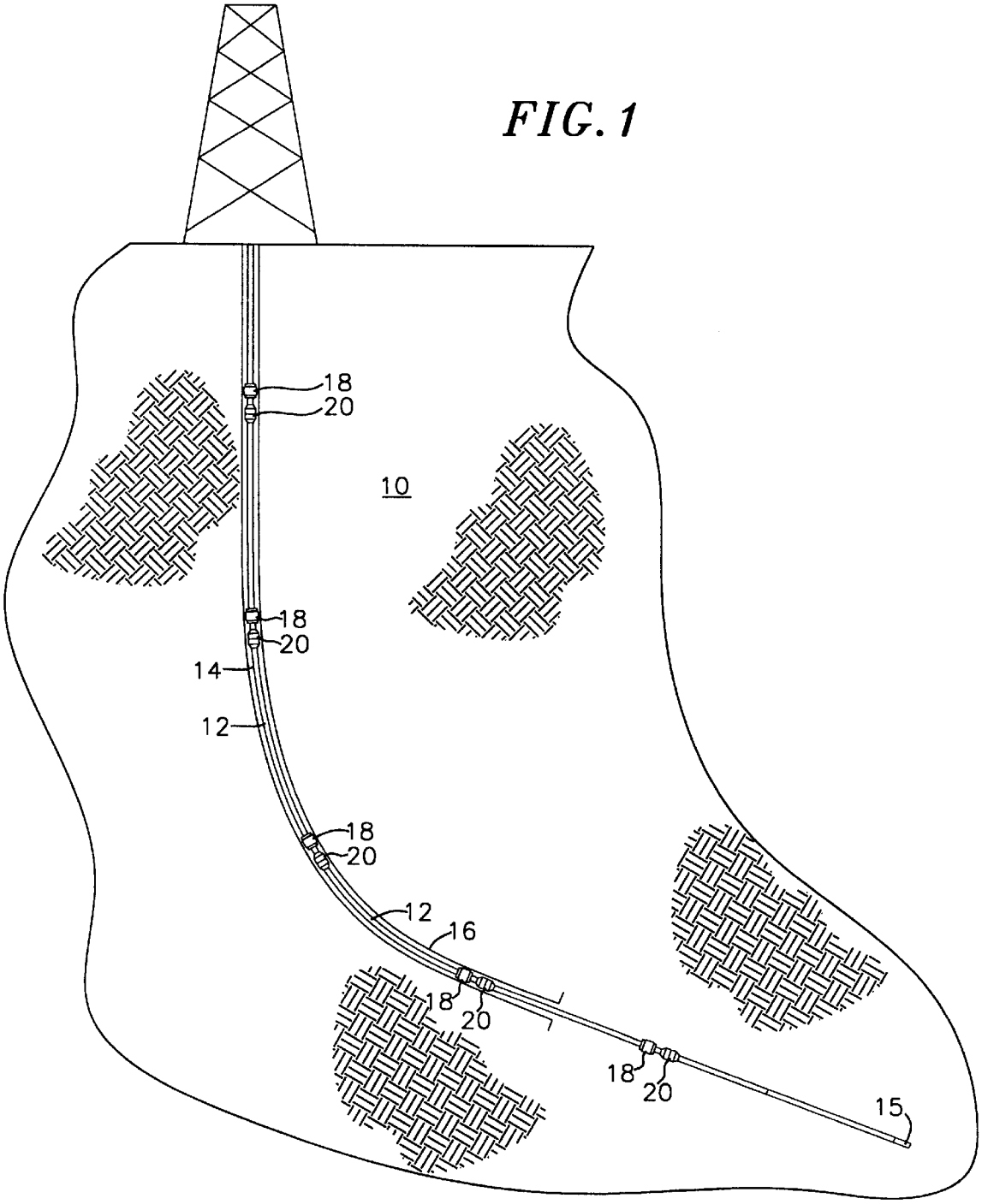
FIG. 1 is a fragmentary schematic side elevational view, partly in cross-section, showing a string of drill pipe having drill pipe/casing protector assemblies according to this invention installed between tool joints of the drill pipe in a deviated well being drilled in an underground formation.

FIG. 1 illustrates a well drilling system for drilling a well in an underground formation 10. A rotary drill string comprising elongated tubular drill pipe sections 12 drills a well bore 14 with a drilling tool 15 installed at the bottom of the drill string. An elongated cylindrical tubular casing 16 is cemented in the well bore to isolate and/or support formations around the bore. The invention is depicted as a deviated well which is drilled initially along a somewhat straight path and then curves near the bottom and to the side in a dog leg fashion. It is the drilling of wells of this type that can substantially increase the wear experienced on the drill pipe or casing and the torque applied to the drill string during use and where and the present invention, by reducing the amount of wear and torque build up, makes it possible to drill such deviated wells to greater depths and to drill them more efficiently while preventing damage to the casing and drill pipe.

The invention is described with respect to its use inside casing in a well bore, but the invention also can be used to reduce torque and protect the drill pipe or casing from damage caused by contact with the wall of a bore that does not have a casing. Therefore, in the description and claims to follow, where references are made to contact with the wall or inside diameter (I.D.) of a casing, the description also applies to contact with the wall of the well bore, and where references are made to contact with a bore, the bore can be the wall of a well bore or the I.D. of a casing.

Referring again to FIG. 1, separate longitudinally spaced apart sleeve-like drill pipe protectors 18 (also referred to as a protector sleeve) are mounted along the length of a drill string to protect the casing from damage while reducing the torque that can occur when rotating the drill pipe inside the casing. The sections of the drill pipe are connected together in the drill string by separate drill pipe tool joints 20 which are conventional in the art. The separate drill pipe protectors 18 are mounted to the drill string 12 adjacent to each of the tool joints to reduce shock and vibration to the drill string and abrasion to the inside wall of the casing. The drill pipe can produce both torque and drill pipe casing wear and resistance to sliding of the drill string in the hole. When the drill pipe is rotated inside the casing, its tool joints would normally be the first to rub against the inside of the casing, and this rubbing action will tend to wear away either the casing, or the outside diameter of the drill pipe, or its tool joints, which can greatly reduce the protection afforded the well or the strength of the drill pipe or its tool joints. To prevent this damage from occurring, the outside diameter of the standard or prior art drill pipe protector sleeve, which is normally made from rubber or a low friction polymeric material, is made greater than that of the drill pipe and its tool joints. Such an installation allows the protector sleeve only to rub against the casing. Although they are useful in wear protection, these standard protectors can generate substantial cumulative torque along the length of the drill pipe, particularly when the hole is deviated from vertical as shown in FIG. 1. This adversely affects drilling operations, primarily by producing friction which works to reduce the rotation, weight, and torque value generated at the surface which are then translated in a reduced form to the drill bit. The present invention provides a solution to this problem.

Figure 2:
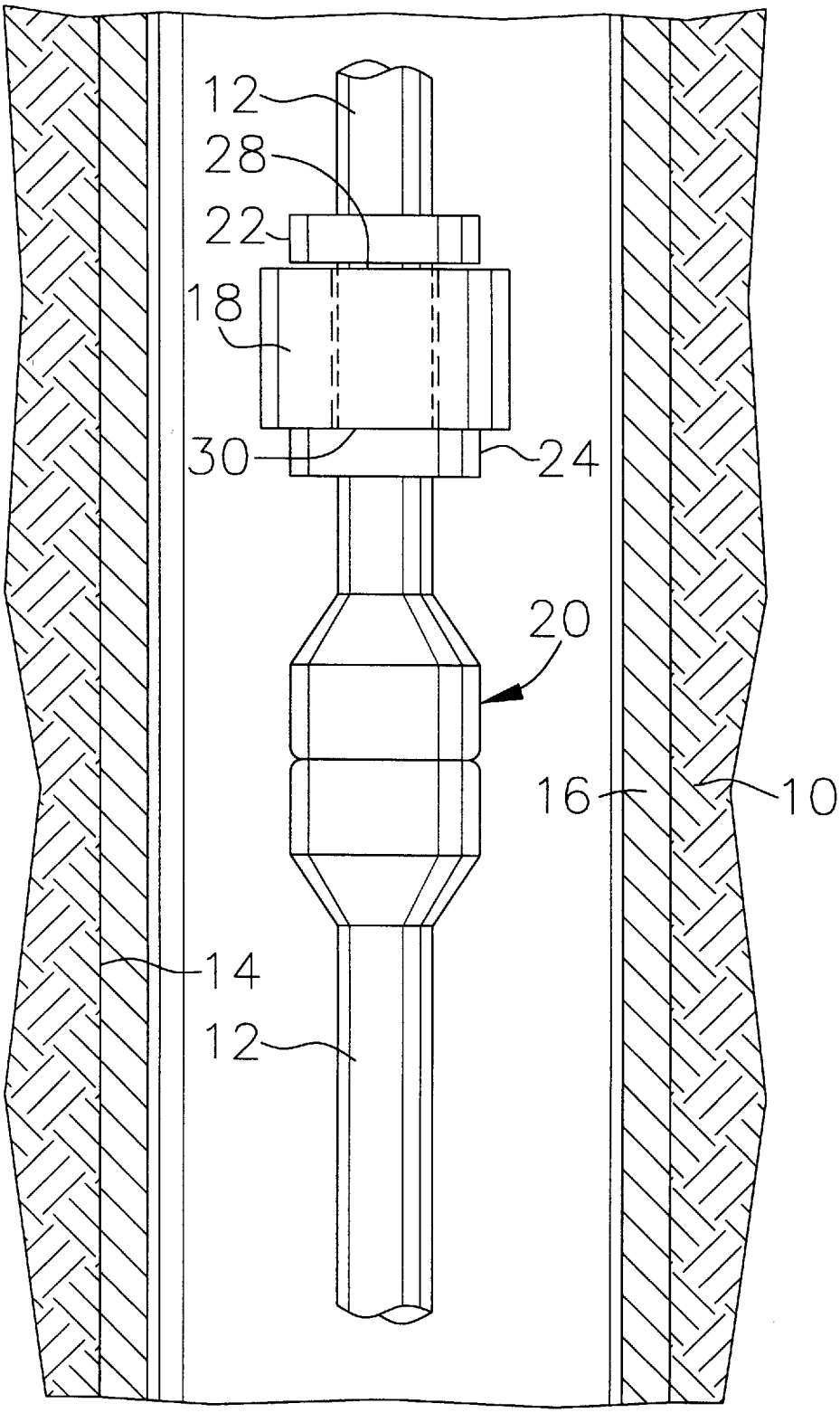
FIG. 2 is a fragmentary semi-schematic side elevational view, partly in cross-section, illustrating a drill pipe protector assembly according to principles of this invention mounted on a drill pipe section located inside a casing which has been cemented or otherwise affixed in a bore in the formation.

FIG. 2 schematically illustrates a drill pipe protector assembly of the form claimed herein mounted to the drill string. The protective sleeve is sandwiched loosely between upper and lower thrust bearings 22 and 24 which are rigidly affixed to the O.D. of the drill pipe section 12. A small gap exists between the protective sleeve and the thrust bearings. The drill pipe protector sleeve is mounted to the drill pipe using techniques which hold the protector on the drill pipe and which allow the sleeve to normally rotate with the drill pipe during drilling operations; but when the drill pipe protector sleeve comes into contact with the casing 16, the sleeve stops rotating, or at least slows down substantially, while allowing the drill pipe to continue rotating inside the protector sleeve. This change in point of rotation from the O.D. of the protector sleeve to the O.D. of the drill pipe, in effect, reduces the distance at which the friction associated with drill pipe rotation is applied to the drill pipe. As a result, the torque applied to the rotary drill string during contact between the sleeve and casing is significantly reduced compared to the prior art arrangements in which the drill pipe protector sleeves were rigidly affixed to the side of the drill pipe.

Protector Sleeve With Fluid Bearing Effect

Figure 3:
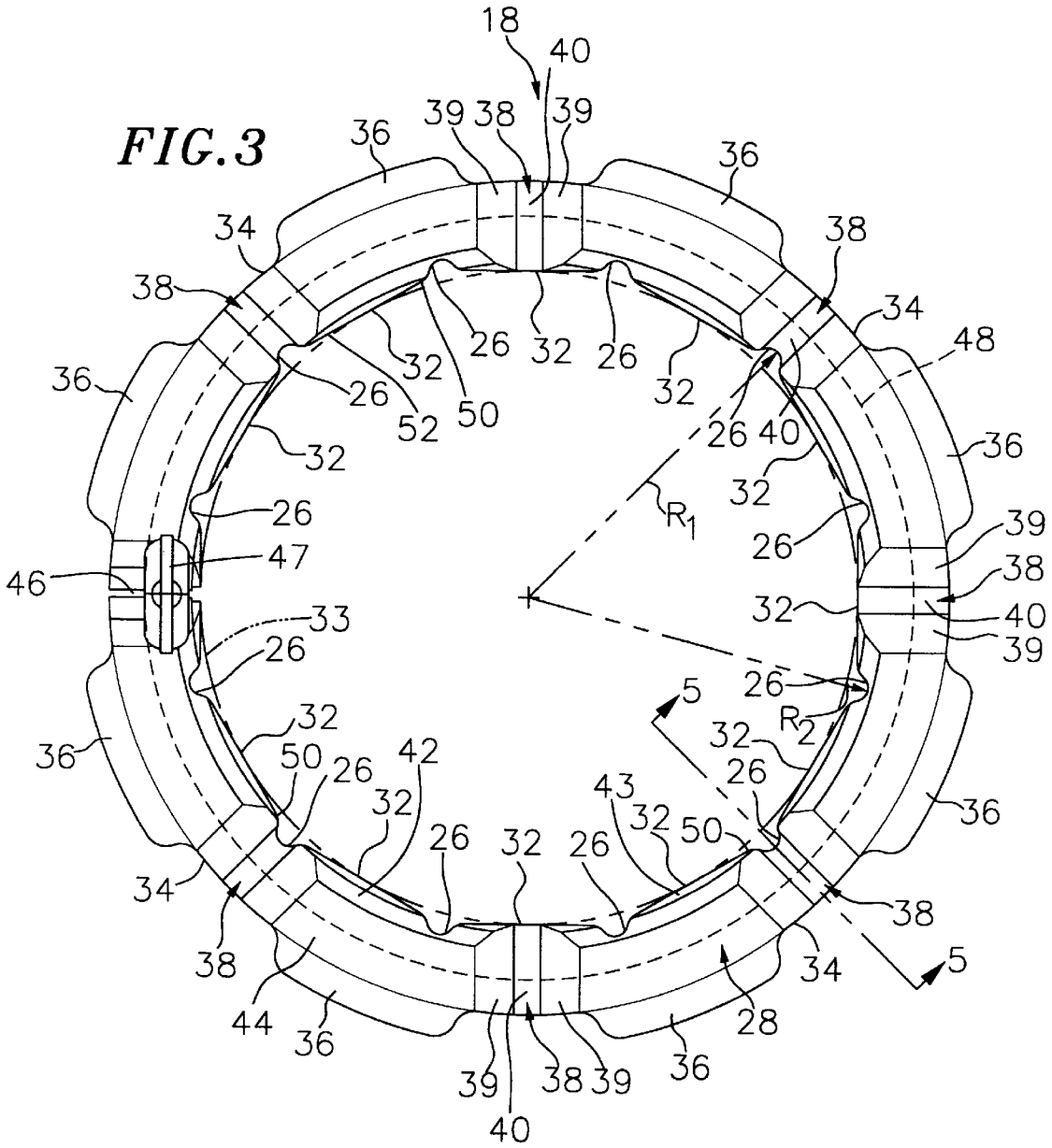
FIG. 3 is a top elevational view showing a drill pipe protector sleeve according to this invention.
Figure 4:
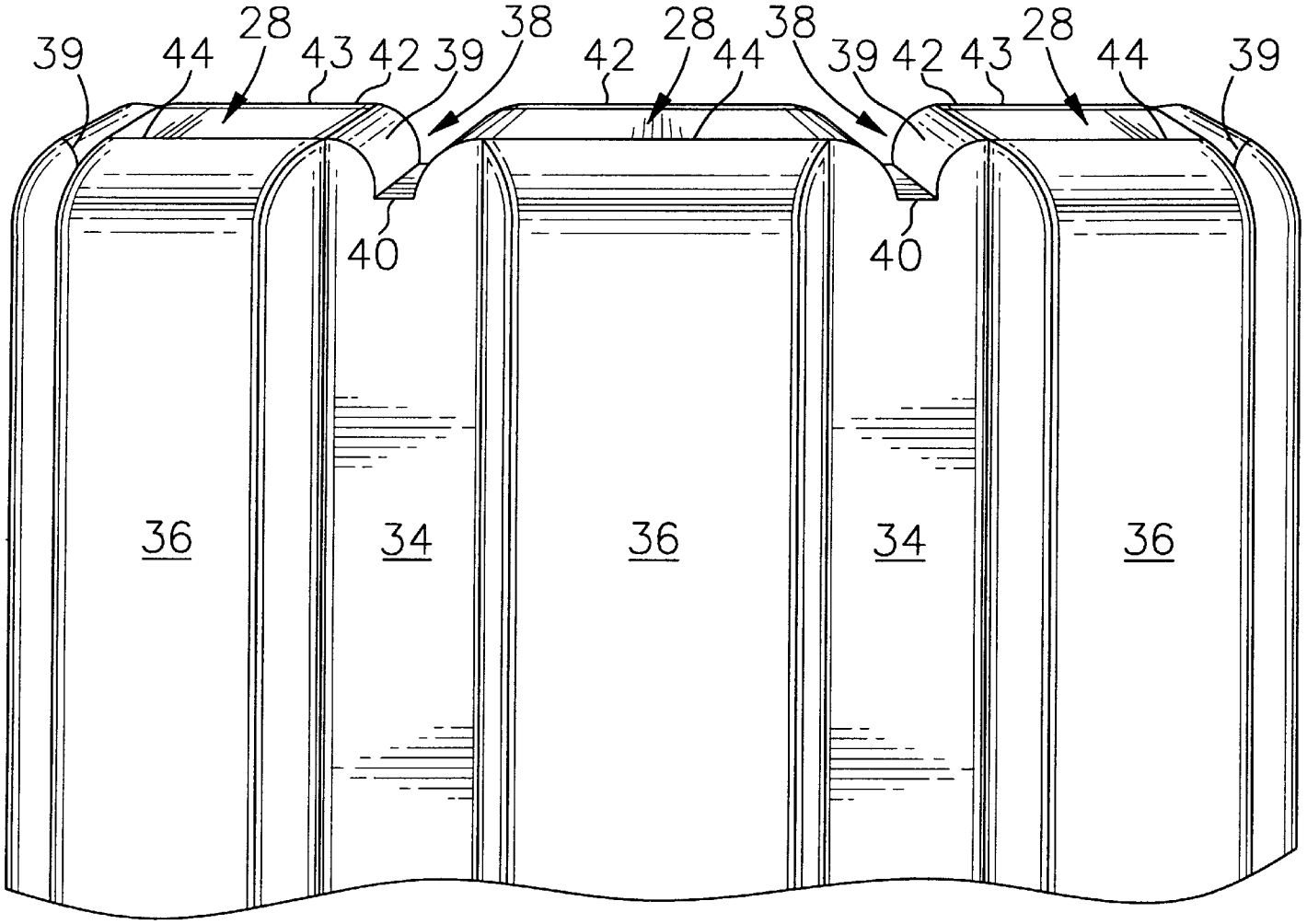
FIG. 4 is a fragmentary side elevational view of FIG. 3.
Figure 5:
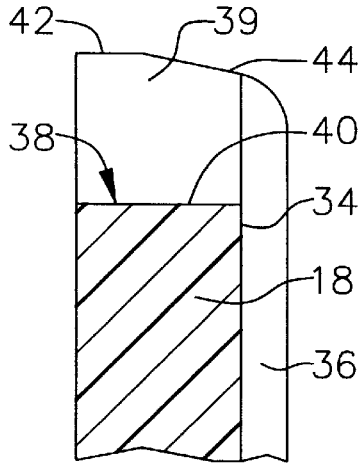
FIG. 5 is a fragmentary cross-sectional view of the drill pipe protector sleeve taken on line 5—5 of FIG. 3.

FIGS. 3 and 4 illustrate detailed construction of the drill pipe protector sleeve 18 which preferably comprises an elongated tubular sleeve made from a suitable protective material, such as, a low coefficient of friction, polymeric material, metal or rubber material. A presently preferred material is a high density polyurethane or rubber material. The sleeve has an inside diameter (I.D.) in a generally polygon shaped configuration described below. The I.D. further includes a plurality of elongated, longitudinally extending, straight, parallel axial grooves 26 spaced apart circumferentially around the I.D. of the sleeve. The grooves are preferably spaced uniformly around the I.D. of the sleeve, extend vertically (i.e., at a right angle to the top and bottom annular ends of the sleeve), and are open ended in the sense that they open through an annular top end 28 and an annular bottom end 30 of the sleeve. (The top and bottom ends 28 and 30 are referenced in FIG. 2.) The base of each groove is on a common fixed radius $R_1$ shown in FIG. 3.

The inside wall of the sleeve is divided into intervening wall sections of substantially uniform width extending parallel to one another between adjacent pairs of the grooves 26. Each wall section has an inside bearing surface 32 that for the most part is a flat surface so that the flat surfaces of the bearing faces 32 together form a generally polygonal shape around the inside of the protector sleeve. The corners of the polygon are located generally on the central axis of the respective grooves 26 formed at the opposite ends of the flat polygon-shaped bearing surfaces. To further define the polygon configuration of the flat bearing surfaces 32, a majority of each bearing face normally makes tangential contact with the circular O.D. of the drill pipe section shown in phantom lines at 33 in FIG. 3. Further design details of the axial grooves 26 and the flat bearing surfaces 32 are described below with respect to presently preferred embodiments of the protector sleeve.

The wall thickness of the sleeve 18 is such that the drill pipe protector has an O.D. greater than the O.D. of the adjacent drill pipe tool joints 20. The O.D. of the sleeve can be circular or can have a plurality of circumferentially spaced apart, longitudinally extending, parallel outer flutes 34 extending from top to bottom of the sleeve. The flutes are substantially wider than the grooves 26 inside the sleeve. Intervening outer wall sections 36 formed by the O.D. wall of the sleeve between the outer flutes form wide parallel outer ribs with circularly curved outer surfaces along the outside of the sleeve.

Circumferentially spaced apart end slots 38 are formed in the annular top end wall and in the annular bottom end wall of the sleeve. These end slots are preferably uniformly spaced apart around the annular top and bottom ends, and usually are aligned radially with the centers of corresponding flutes 34 extending along the O.D. of the sleeve. As shown best in the side elevation view of FIG. 4, the end slots have radially curved upper edges 39 which converge downwardly toward one another and open into a narrow, generally U-shaped channel 40 at the bottom of each end slot.

The annular top and bottom edges of the protector sleeve also have a configuration that functions to draw fluid between the sleeve and collar, thereby assisting in the formation of a fluid bearing effect in this region. The top and bottom edges have a generally flat annular inside edge section 42 extending horizontally and generally at a right angle to the vertical inside walls of the sleeve. The edge section 42 has a bevelled edge 43 leading to the vertical inside walls to prevent or reduce the wear to the drill pipe brought about by the action of axial forces. The inside edge is of uniform width around the inner circumference of the annular end wall. It merges with an annular angular outer edge section 44 that extends downwardly and outwardly along a 0° to 30° angle around the outer portion of the annular end wall of the sleeve. A 15° angle of inclination is preferred although other angular configurations can be used. The angular end walls of the mating sections of the sleeve work to reduce wear to be experienced on the ends of the protector sleeve and the drill pipe when acted upon by heavy axial loading. Other end wall configurations are described below.

The drill pipe protector sleeve is split longitudinally to provide a means for spreading apart the opposite sides of the sleeve when mounting the sleeve to the O.D. of the drill pipe. The top view of the sleeve shown in FIG. 3 illustrates a pair of diametrically opposed and vertically extending edges 46 that define the ends of a longitudinal split that splits the sleeve into two halves. The sleeve is split longitudinally along one edge 46 which is fastened by a latch pin 47. In this version, the sleeve is simply spread apart along the edge 46 when installed. Alternatively, the sleeve halves may be hinged along one side and releasably fastened on an opposite side by a latch pin, or they may be secured along both opposite sides by bolts. A metal cage (not shown) forms an annular reinforcing ring embedded in the molded body of the sleeve. The embedded cage is illustrated generally by the phantom lines 48 for simplicity, and the description to follow describes the metal cage and its functions. Further description is provided in U.S. Pat. No. 5,069,297 which is incorporated herein by reference. (In protector sleeves made of metal no reinforcing cage is used.) The purpose of the cage is to reinforce the strength of the sleeve. The cage can absorb the compressive, tensile, and shear forces experienced by the sleeve when operating in the casing or well bore. The reinforcing cage or insert can be made from expanded metal, metal sheet stock, or metal strips or composite (fiber). One presently preferred technique is to form the reinforcing member from a steel sheet stock with holes uniformly distributed throughout the sheet. Although any suitable attachment mechanism can be utilized, in one embodiment illustrated in detail in the '297 patent, a first set of vertically spaced apart fastening fingers project from one side of the cage and a cooperating set of vertically spaced apart metal fastening fingers project from the opposite side of the cage. These fingers are integrally affixed to the metal cage through metal reinforcing members affixed to the cage and embedded in the molded sleeve. In mounting the sleeve to the O.D. of the drill pipe, the fingers are interleaved and spaced apart vertically to receive a latch pin (not shown) which is driven through vertically aligned eyes on the fingers. This draws opposite sides of the sleeve together around the O.D. of the drill pipe, leaving approximately ⅛ inch clearance between the I.D. of the sleeve and the O.D. of the drill pipe. The above metal components are attached to the fingers and are hinged in strong fashion allowing the locking pin to be driven through the matching eyes of the hinge and thus securely closing the sleeve.

The confronting top and bottom thrust bearings 22 and 24 as described in FIG. 2 have adjacent annular end surfaces confronting the top and bottom annular end surfaces of the sleeve at essentially the same angular orientations. In each embodiment of the protector sleeve disclosed herein, the adjacent fixed thrust bearing has a similar end surface configuration such similar configuration are described, for example, in the referenced '297 patent. The upper and lower thrust bearings 22 and 24 are rigidly affixed to the O.D. of the drill pipe above and below the drill pipe protector sleeve. The thrust bearings (also referred to as collars) are metal collars made of a material, such as aluminum, or a hard plastic materials, such as, composites of teflon and graphite fibers to encircle the drill pipe and project outwardly from the drill pipe. The collars project a sufficient axial distance along the drill pipe to provide a means for retaining the sleeve in an axially affixed position on the drill pipe, restrained between the two thrust bearings. The thrust bearings are rigidly affixed to the drill pipe and rotate with the drill pipe during use. The means for securing the thrust bearings to opposite ends of the sleeve can be similar to the fastening means shown in U.S. Pat. No. 5,069,297 referred to previously. The upper and lower thrust bearings are affixed to the drill pipe to provide a very narrow upper working clearance between the bottom of the upper thrust bearing and the annular top edge of the sleeve and a separate lower working clearance between the top of the lower thrust bearing and the bottom annular edge of the sleeve. The lower clearance can be narrow such as ¼" or a clearance as much as 1". In one embodiment, the bearings above and below the sleeve are at least about four inches in vertical height to provide sufficient surface area to grip the pipe to provide a means for securely holding them in a rigid fixed position on the pipe. The bearings are preferably split and bolted or hinged and bolted with spaced apart cap screws on outer flanges of the collar. More detailed descriptions of the collar structure are provided in the '297 patent.

During use, when the rotary drill pipe is rotated within the casing or well bore, the outer surface of the drill pipe protector sleeve comes into contact with the interior surface of the casing or well bore. The sleeve, which is normally fixed in place on the drill pipe, rotates with the drill pipe during normal drilling operations. However, under contact with the inside wall of the casing, the sleeve stops rotating, or its rotational speed is greatly reduced, while allowing the drill pipe to continue rotating inside the sleeve. The configuration of the I.D. of the sleeve is such that the drill pipe can continue rotating while the sleeve is nearly stopped or rotating slightly and yet its stoppage exerts minimal frictional drag on the O.D. of the rotating drill pipe. The polygon-shaped flat inside bearing surfaces of the sleeve, in combination with the axial grooves, induces the circulating drilling mud within the annulus between the casing and drill pipe to flow under pressure through a clearance area at one end of the sleeve and through the parallel grooves to a clearance area at the opposite end of the sleeve. These clearance areas are provided by the recessed end slots in the annular end faces of the sleeve. This produces a circulating flow of drilling mud under pressure at the interface of the sleeve and drill pipe and this fluid becomes forced into the flat bearing surface areas between the grooves. This deforms or spreads apart the bearing surface regions to produce a pressurized thin film of lubricating fluid between the sleeve I.D. and drill pipe O.D. which reduces frictional drag between these two surfaces. This action of the lubricating fluid being forced into the region between the sleeve and drill pipe acts as a fluid bearing to force the two surfaces apart, and such action thereby reduces the friction that would normally be experienced both on the O.D. of the drill pipe and the I.D. of the sleeve due to the fact that a thin film of fluid is separating the two surfaces. Since the fluid separates these two surfaces the torque developed as a result of rotation is greatly reduced.

In addition, the thrust bearings at opposite ends of the sleeve, which retain the sleeve's position on the drill pipe, also assist in producing a further fluid bearing effect at the ends of the sleeve. The bearings in combination with the recessed end slots at the ends of the sleeve produce an enhanced lubricating effect at the ends of the sleeve. During use, these clearance areas above and below the sleeve provide an improved means of circulating the surrounding drilling fluid into the annular space between the sleeve and the drill pipe, thereby working to reduce friction. Still further, these end slots also prevent a seal between the sleeve and the collar from forming thus preventing a build up of particle concentration at the sleeve and collar interface which would make it difficult to provide sufficient fluid film in this area to separate these particles from the sleeve I.D. and drill pipe O.D., thereby reducing wear to either surface or jamming, and prevents a build up of pressure to occur between the sleeve and drill pipe and collar interface that could lead to a blocking/pressure build up that could force the collars along the length of the drill pipe or "blow up" the sleeve.

As mentioned previously, the generally flat bearing surfaces on the I.D. of the sleeve are in tangential contact with the circular O.D. of the drill pipe. The number of polygon sides (the number of flat intervening bearing surfaces) varies depending upon the size (diameter) of the protective sleeve. Within limits, an increase in the number of flat bearing faces can produce reduced frictional drag on the drill pipe during drilling operations. The embodiment illustrated in FIG. 3 shows ten parallel grooves with ten intervening flat bearing faces of the polygon shaped sleeve I.D. tangentially contacting the O.D. of the drill pipe. Studies have been conducted on the relationship between the number of polygon sides and their contribution to increasing or reducing the coefficient of friction. In one study, it was determined that the ratio of the diameter (D) to the number of sides (n) for a given polygon is in the range of 0.394 to 0.49 for a five-inch diameter polygon. Therefore, these studies have shown that the number of flat polygon faces is between about ten and about thirteen for the five-inch diameter sleeve. These studies have also shown that the lowest friction coefficient was provided in a unit having between twelve and thirteen polygon faces. For a six-inch diameter protector, similar studies have shown that the ratio D÷n= 0.416, or that about fourteen to fifteen polygon sides produce the lowest coefficient of friction.

Referring to FIG. 3, the I.D. wall of the sleeve has a radially curved configuration between the ends of the tangential flat bearing surfaces and the axial grooves. Preferably, the bottoms of the axial grooves are curved on a short radius shown in FIG. 3 of curvature $R_2$. The opposite ends of each axial groove and the corresponding flat bearing surfaces merge along a radially curved transition region. FIG. 3 illustrates preferred embodiment for efficiency but other embodiments are possible. A radially curved transition surface 50 between the ends of each flat bearing surface 32 and each axial groove.

The long, flat polygon configurations of the internal bearing surfaces of the sleeve are specifically designed to minimize the overall coefficient of friction of the drill pipe-sleeve system. The overall coefficient of friction is the combination of the contact (static or dynamic) and the hydrodynamic friction. Friction for the system is highest with contact friction and lowest with hydrodynamic friction. The invention adopts a combination of the two effects.

Generally speaking, the number of polygon surfaces on the interior bearing surface is determined by the ratio of inside diameter of the sleeve to 0.394±0.01. In equation form:

$$n=ID/0.396$$

where

ID=sleeve inside diameter (inches)

n=number of sides of the polygon

In one embodiment, the axial grooves have a bottom minimum radius of typically 0.25 inches, blending to become a tangent to the polygon surface on the interior of the sleeve. The blend radius is preferably about 1.5 times the radius of the lubricant groove, but can be within the range from 1.0 to 3.0 times the radius of the axial groove. The ratio of the top blend radius to the bottom groove radius (the groove design ratio) is commonly 1.33 to 1.66 and described in the following equation:

$$R=B/G$$

where

R=groove design ratio

B=the blend radius from the groove to the polygon tangent(inches)

G=groove radius(inches)

The blended radially curved configuration from each axial groove to the adjacent polygon surface of the sleeve allows "cuttings" from drilling and other debris to be carried in the fluid with minimal effect on system lubrication. The tangent acts to "ramp" or "funnel" the fluid to the polygonal surface of the sleeve, inducing hydraulic "support" for the drill string, while serving to eliminate particles in the fluid from reaching the areas of the polygons or flat surfaces.

In addition, the groove shape with the tangent blend partially compensates for the deformation of the sleeve's polygonal surface resulting from drill string loads. Without this compensation, a "bulge" can be produced that would inhibit lubrication to the interior of the polygonal surfaces and increase system friction.

The depth of each lubrication groove (the axial groove 26) is typically 0.3–0.4 inches deep with a bottom radius of 0.1875 to 0.250 inch. The depth of the groove (and the resulting channel cross-sectional area) is sized to provide sufficient lubrication to the interior of the sleeve and serves as a place to collect cuttings, thus preventing them from positioning themselves between the sleeve and drill pipe and bringing about wear to the latter. The volume of the groove is determined by the following relationship:

$$A \geqq hL/dv$$

where

A=cross-sectioned area of the groove h=hydrodynamic fluid layer from the sleeve to the drill string L=length of the protector d=density of the drilling fluid (lubricant)

v=velocity of fluid down the groove

Experiments have shown that grooves which are not longitudinal with respect to the axis of the protector do not provide optimum lubrication. The result is a tendency to leave parts of the sleeve under lubricated, thus increasing system friction.

The preferred length of the protector is approximately 2–5 times the I.D. of the protector. The relationship is shown in the following equation:

$$f=L/(ID)$$

where

L=length of the protector sleeve

ID=ID of the protector sleeve f=factor ranging from 2–5

The factor selection is based on the following:

(a) Providing appropriate surface area to support the normal (loads applied perpendicular to surface) loads from the drill string. The practical operating load on a sleeve is approximately 2000 pounds for one size of protector sleeve. (The equation for maximum lift generated is F=DL×40 psi, and where drawer D=5 inches and length L=10 inches, lift=2,000 pounds.) The protector loads could range from 0–4000 pounds. For a protector with an 80 durometer hardness, typically the polygonal pads support stresses of 35–40 psi.

(b) Providing sufficient lubrication to the polygonal surfaces of the sleeve to produce an adequate hydraulic component reducing the system friction.

(c) Appropriate sleeve length to limit or prevent appreciable separation of the drill string from the sleeve (and hence loss of lubrication) as a result of bending of the drill string or local end "belling" as a result of bearing end loads.

(d) The surface area is affected by the hardness of the protector such that greater hardness (for the non-metallic sleeve) results in less sleeve deformation and greater proportion of hydrodynamic support.

The sleeve assembly may or may not be symmetrical about the end of the sleeve, however typical designs for sleeves are symmetric. The symmetry of the sleeve affords the advantage that the protector can be reversed in position on the drill pipe. This effectively doubles the useful life of the sleeve because if one end is damaged or worn, the protector sleeve can be reversed and returned to service immediately. Secondly, the symmetry about the ends of the sleeve facilitates installation because specific orientation is not necessary during makeup.

Sleeve Liner for Protection Sleeves

Figure 6:
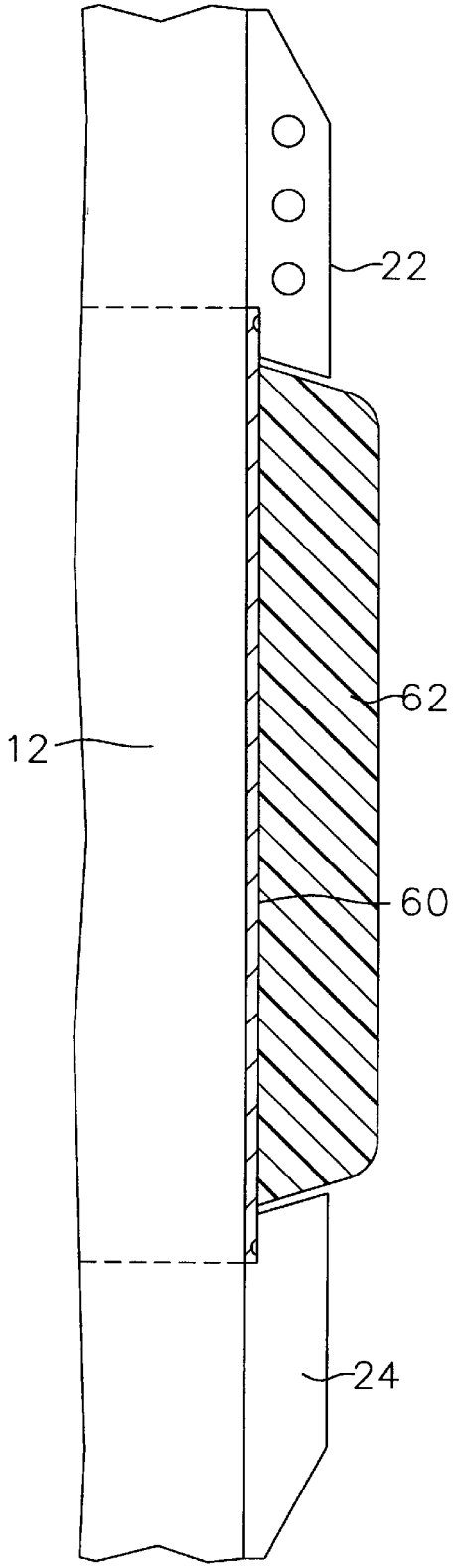
FIG. 6 is a fragmentary semi-schematic side elevational view, partly in cross-section, showing a drill pipe sleeve liner mounted between the outside of the drill pipe and the inside of the protector sleeve.
Figure 7:
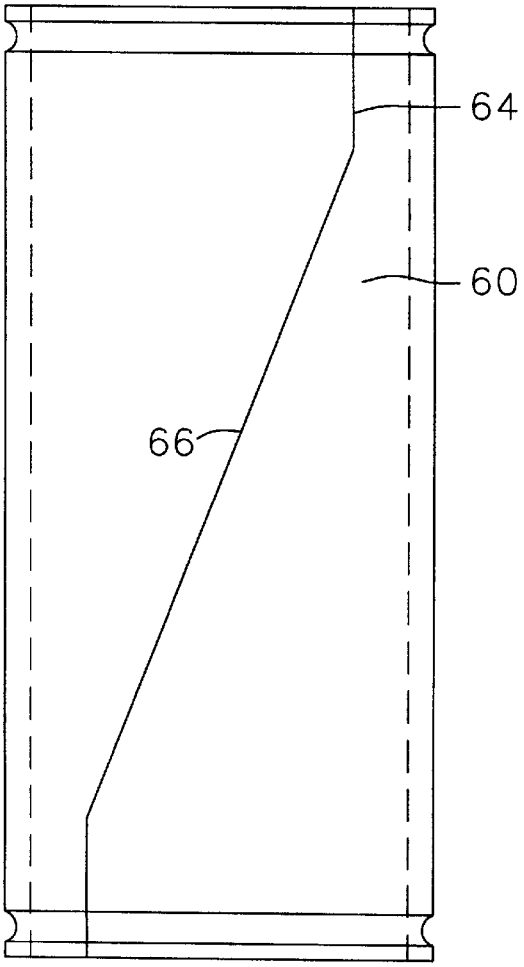
FIG. 7 is a side elevational view of the drill pipe liner of FIG. 6.

FIGS. 6 and 7 illustrate a sleeve liner 60 mounted between the O.D. of the drill pipe and the I.D. of a protector sleeve 62. (The protector sleeve 62 has a configuration similar to the protector sleeve 18 described previously.) The liner sleeve is a thin-walled tubular liner rigidly held in place on the drill pipe 12 between the fixed end bearings 22 and 24. The sleeve is preferably made from a metal or plastic or composite commonly having a hardness greater than the drill pipe material, to reduce wear on the drill pipe in high solid fluid mediums from relative rotation between the drill pipe and the protector sleeve. The sleeve liner can have an axial or helical cut or have an axially extending cut 64 with an angular intermediate section 66 shown in FIG. 7 to facilitate installation while inhibiting torsional shear deformation of separating the liner from the drill pipe and sleeve. The sleeve liner is preferably held in place by compression fit to the end bearings but can also be attached to same for ease in installation. This design prevents entrapment of particles from drilling mud being caught between the sleeve and the drill pipe. These captured particles otherwise can lead to abrasive loss of the drill pipe wall.

Improved Reinforced Case For Protector Sleeves

One embodiment of the non-rotating drill pipe protector described previously consists of two thrust bearings made of metal such as aluminum and a protector sleeve made of a polymeric material. Another embodiment uses an elastomeric material for the sleeve. The sleeve is reinforced with a steel cage which is hinged to allow assembly of the sleeve onto the drill pipe. The cage also has a large matrix of holes preferably with a ½ inch diameter that facilitate bonding of the cage to the elastomer. This configuration is frequently used in wells with elevated formation temperatures, typically 250–400 degrees F. Elastomeric materials are used because of their reported superior performance at elevated temperatures. In some cases where the protectors are exposed to elevated temperatures for several days (3–5 day period), large pieces (1–4 inches in length) of elastomeric material may be observed to float to the surface, carried by the drilling mud. Another observation of cages returned to the surface without any rubber remaining on the cage suggests elastomeric delamination. One failed sleeve displayed a shear failure between the cage and the elastomer that propagated to the end surface of the cylindrical protector. Typically the failure appeared to originate near the protector pin and hinge points and then propagated circumferentially around the sleeve.

Samples of the protector sleeve were tested in a manner intended to emulate field loads on the sleeve. In the field, the collars and sleeves were placed on the drill string and lowered into the hole. As the sleeve slid down the hole, it experienced friction on its exterior surface from the casing or formation, thrusting the sleeve into the adjacent fixed collar or thrust bearing. Five elastomeric sleeves were tested. The elastomeric material in all sleeve samples was carboxylated nitrile butadiene rubber (NBR). All samples had the same external configuration: I.D.=5.14 inches, O.D.=7.25 inches, Length=9.125 inches. The reinforcement cage in the sleeve had an O.D. of 6.0 inches and a length of 7.6 inches.

Three of the samples incorporated the standard 7.6 inch steel reinforcement cage described previously; two of the samples incorporated a modified cage design which included bending a 0.25 inch long 90 degree lip at each end of the standard cages. The length of the modified protector cages was 7.1 inches. The cage improvement incorporated a 90 degree lip at the end of the cage. With this configuration the existing manufacturing rolling process included post processing of the cage to incorporate the lip. The lip was manufactured by cutting periodic 0.25 inch slots in the end of the cage and then bending the slots outward. Another method can include alternately bending one lip flap inward and the next outward alternately around the top and bottom edges of the cage. Another method is to bend all the lips inward. A further method includes incorporation of multiple studs located in the body or at the ends of the cage.

The tests showed improvements in increased load capacity of the sleeve and prevention of delamination between the cage and the sleeve elastomer. The results of this test indicated a 15%–45% increase in the apparent shear strength of the sleeve-cage assembly.

Figure 8:
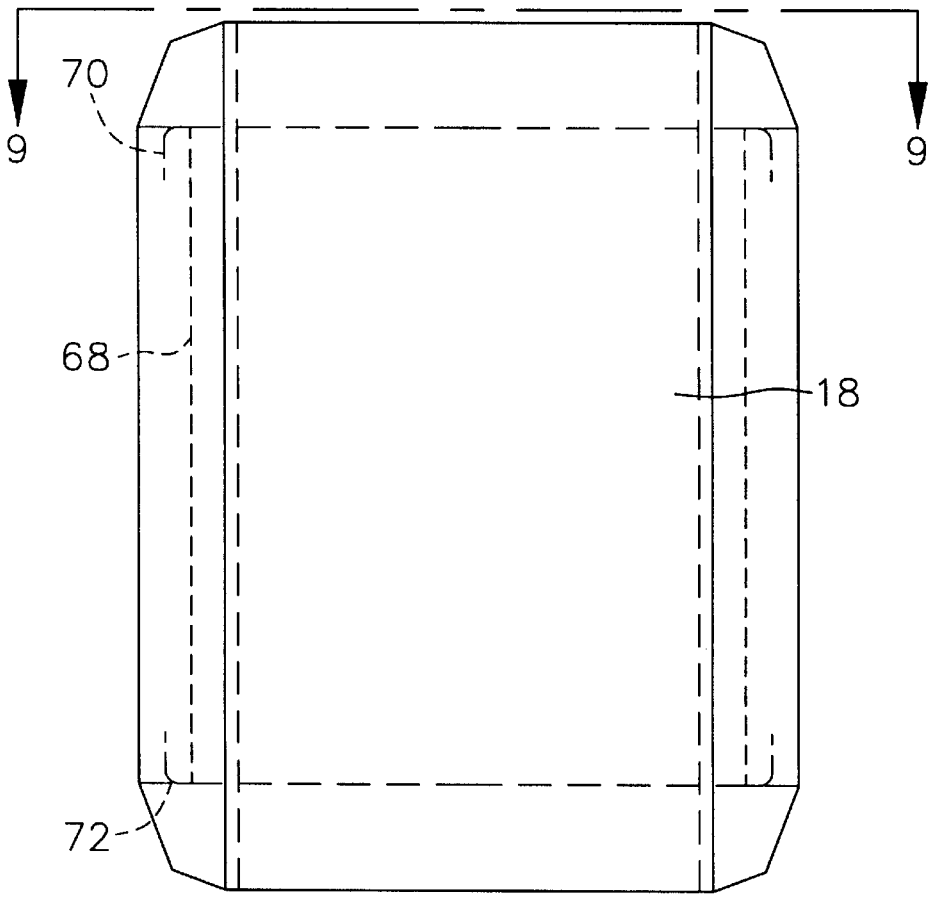
FIG. 8 is a schematic side elevation view showing an alternative embodiment having a reinforcement cage structure for improving shear strength of the protector sleeve.
Figure 9:
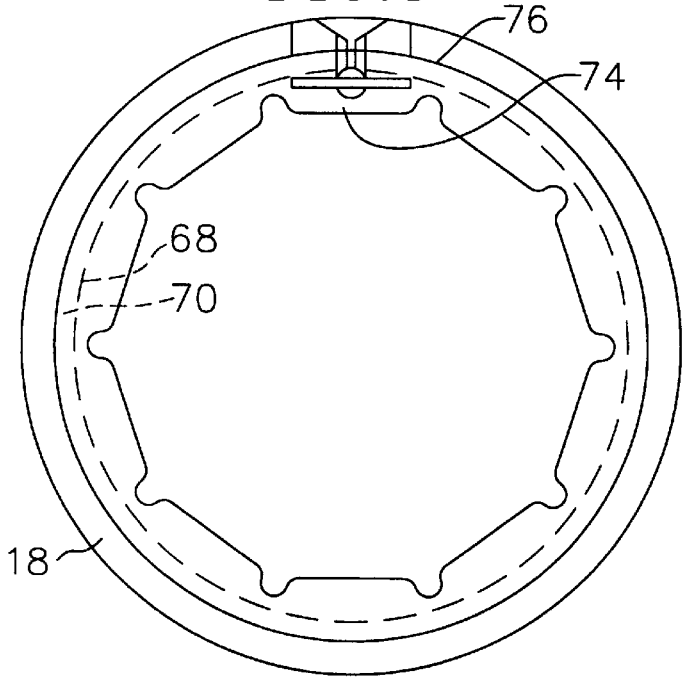
FIG. 9 is a top view taken on line 9—9 of FIG. 8.

Referring to FIGS. 8 and 9, one embodiment of the modified cage structure comprises a cylindrical cage 68 embedded in the protector sleeve with a flanged annular upper lip 70 projecting outwardly at a 90° to 180° angle from the top edge of the cage. A flanged annular lower lip 72 extends outwardly at a 90° angle from the lower edge of the cage. The entire cage structure is embedded in the elastomer, with the upper and lower lip rings 70 and 72 being spaced from the annular top and bottom ends of the sleeve. A locking pin 74 with spaced apart fingers 76 are shown at the end of the split cage structure. This embodiment of the sleeve is simplified and shows a cylindrical outer surface although a fluted outer surface also can be used.

Suction-Flow Fluid Fed Hydraulic End Bearing

Although the drill pipe protector provides a good hydraulic bearing for the interior of the sleeve-drill pipe, the ends of the sleeve that interface to the collars can experience substantial wear. The flow channels 38 over the ends of the sleeves promote flow of fluid over the surface of the sleeve ends. With appropriate sizing of the end channels a hydraulic bearing is created between the sleeve and the retaining collar. Development of a hydraulic bearing in this area greatly improves the end wear characteristics of the sleeve.

Figure 10:
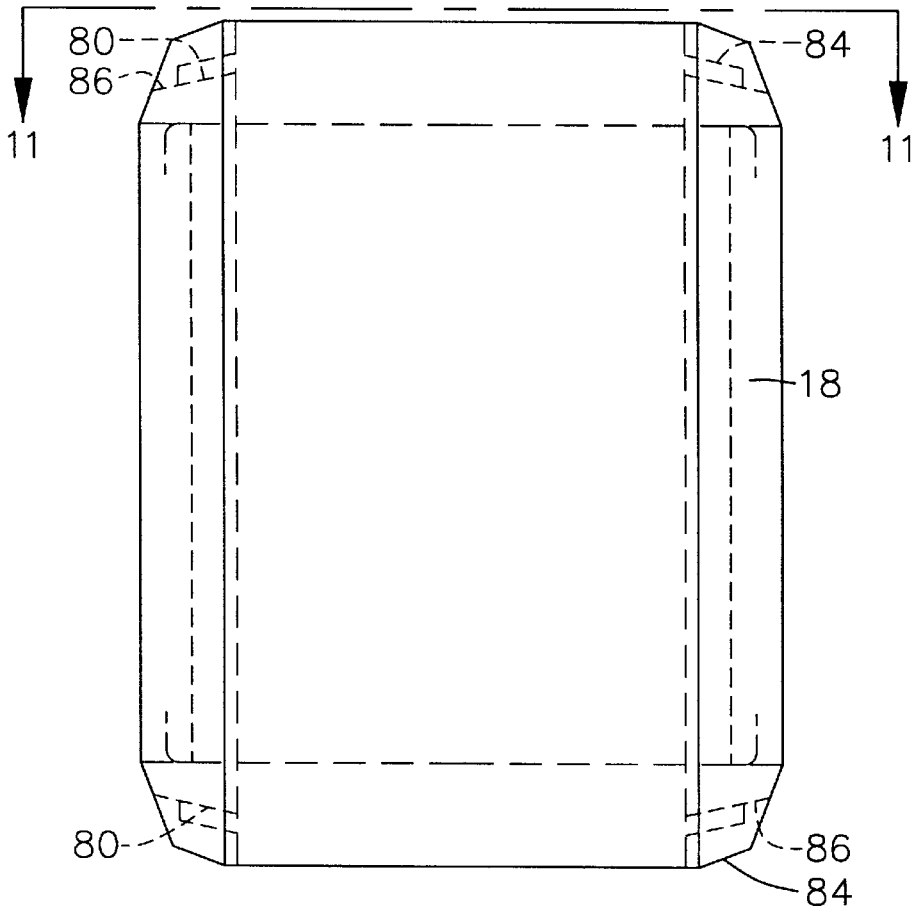
FIG. 10 is a schematic side elevation view showing an alternative embodiment having flow channels and suction reservoirs in the annular ends of the protector sleeve.
Figure 11:
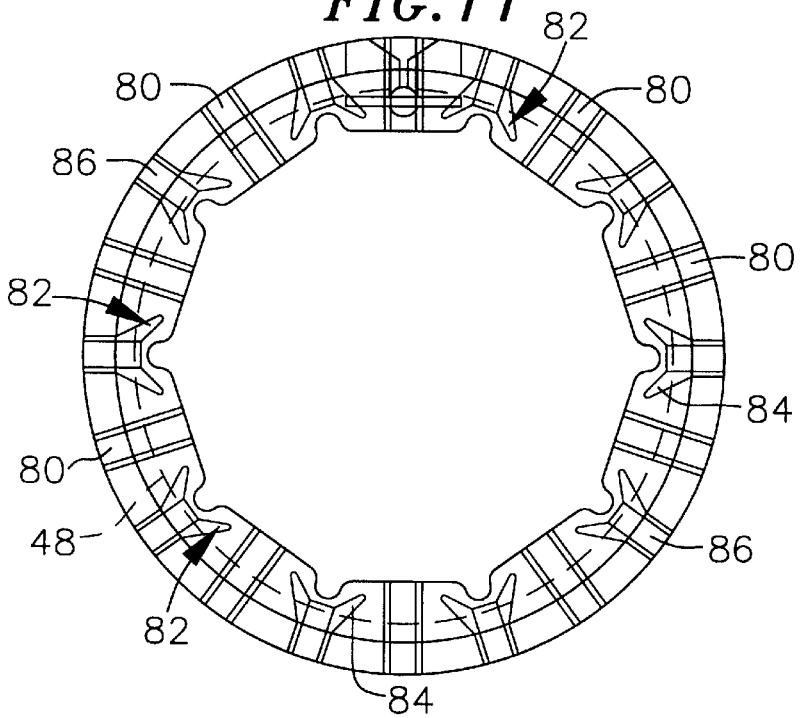
FIG. 11 is a top view taken on line 11—11 of FIG. 10.

FIGS. 10 and 11 illustrate an improvement having suction-flow lubrication of the end bearing. With improved lubrication of the end bearing, wear of the ends of the sleeves is improved. Referring to FIGS. 10 and 11, radial flow channels 80 similar to channels 38 are spaced apart around the annular top and bottom ends of the sleeve. Spaced apart suction reservoirs 82 are formed in the top and bottom ends of the sleeve between the flow channels 80. The suction reservoirs have enlarged recessed regions 84 adjacent to but spaced from the I.D. of the sleeve. They extend radially outwardly and downwardly along a shallow slope and taper or converge into a narrower channel portion 86 that opens through the O.D. of the sleeve.

In use, rotation of the drill pipe relative to the protector in combination with the channels and suction reservoirs acts to centripetally pump the mud from the interior of the protector across the bearing surface, providing a hydraulic layer. As the drill pipe rotates within the protector sleeve, mud that moves up the interior of the sleeve exits into the gap between the end of the protector and the fixed collar or thrust bearing. In the protector disclosed in the '297 patent, mud moves out past the interface of the sleeve and the protector. The drilling fluid is not forced along any specific pathway. In this invention the radial grooves (channels) on the ends of the sleeve conduct the flow to the perimeter (O.D.) of the sleeve. The placement and number of channels is such that there is a tendency to establish a hydraulic film (hydraulic bearing effect).

In addition, the suction reservoirs are placed in proximity to the radial channels. With the drill pipe rotating inside the sleeve, the motion of the pipe tends to move the fluid radially from the interior to the exterior of the sleeve, as with a centrifugal pump. As fluid moves up the radial grooves, the moving fluid tends to have lower pressure than that in the suction reservoirs, and the fluid in the channels tends to suck mud from the reservoirs. The result is the mud moves down the suction reservoirs, across the sleeve-collar interface (bearing), and into the channels. Lubrication of the sleeve-collar interface is improved, and the wear life of the sleeve is improved.

Greatest wear on the ends of the protectors occurs on the end of the sleeve that is closest to the rotary table. This occurs because of the bearing loading on the ends of the protector experienced during drilling. Hence, the upper end (nearest the surface) tends to wear out much before the lower (nearest the drill bit) end.

To provide additional life, this invention is reversible (mirrored about its mid plane). That is, each end of the sleeve can be equipped with the same configuration. By removing the protector and re- installing in the inverted position, the effective working life of the protector is doubled.

Thus, the flow channels and suction reservoirs cooperate to distribute fluid over the end of the sleeve to lubricate it, with the suction reservoirs acting as low pressure sources that draw fluid from the flow channels over the end of the sleeve. The improvements include: (1) establishment of a hydraulic bearing on the ends of the sleeve, which also reduces the torque that would otherwise be seen, (2) increased sleeve wear life because of reduced friction on the ends of sleeve ends, (3) increased collar wear life because of reduced friction on the ends of the collars, (4) reduced sliding friction of the sleeve down and up, and (5) improved life because of reversibility of the sleeve.

Sleeve End Configuration

A problem sometimes observed with the use of a protector sleeve is abrasion to the drill pipe under the sleeve particularly when the abrasives solids content in the fluid medium are high. Examination of wear pattern indicates greatest wear occurs on the pipe at a point corresponding to the ends of the sleeves. Corresponding wear patterns are observed both in elastomeric and polymeric (polyurethane, etc.) types of sleeves; however, greater wear tends to occur in elastomeric sleeves. Specifically, the wear is greatest near the end of the sleeve but tends to reduce toward the center of the sleeve.

Investigations into the mechanism of these wear patterns began with mechanical testing of protectors similar to those described in FIGS. 3 through 6. It was observed that as these protector sleeves were axially loaded, the ends of the sleeves deformed inward toward the drill pipe. The deformation direction was attributable to the 15 degree taper angle on both the collar and the sleeve. Increasing loads progressively tended to deform the sleeve inward toward the drill pipe. The greatest displacements occurred at the ends of the sleeves, which contact the drill pipe first. As loads were increased, the increased length of the sleeve I.D. became deformed and came into contact with the drill pipe.

Normal design procedures for protector sleeves are based on normal contact load to the sleeve resulting from geometric orientation in the hole (perpendicular contact loads) and overpull from the derrick. Overpull is the dynamic force required to overcome string/casing friction, hydraulic resistance, and inertia while "tripping-out" (bringing to the surface). Overpull forces vary from 50,000–300,000 pounds on the drill string. Overpull force is distributed along the length of the drill string, resulting in large loads on the sleeve.

Normal and overpull forces deform the sleeve towards the drill pipe, as discussed above. It appears that as the elastomeric sleeve reaches contact with the pipe, that particulate from the drilling mud can be trapped between the sleeve and the pipe. The result is a scouring of the drill pipe by the particulate material trapped by the protector.

Figure 12:
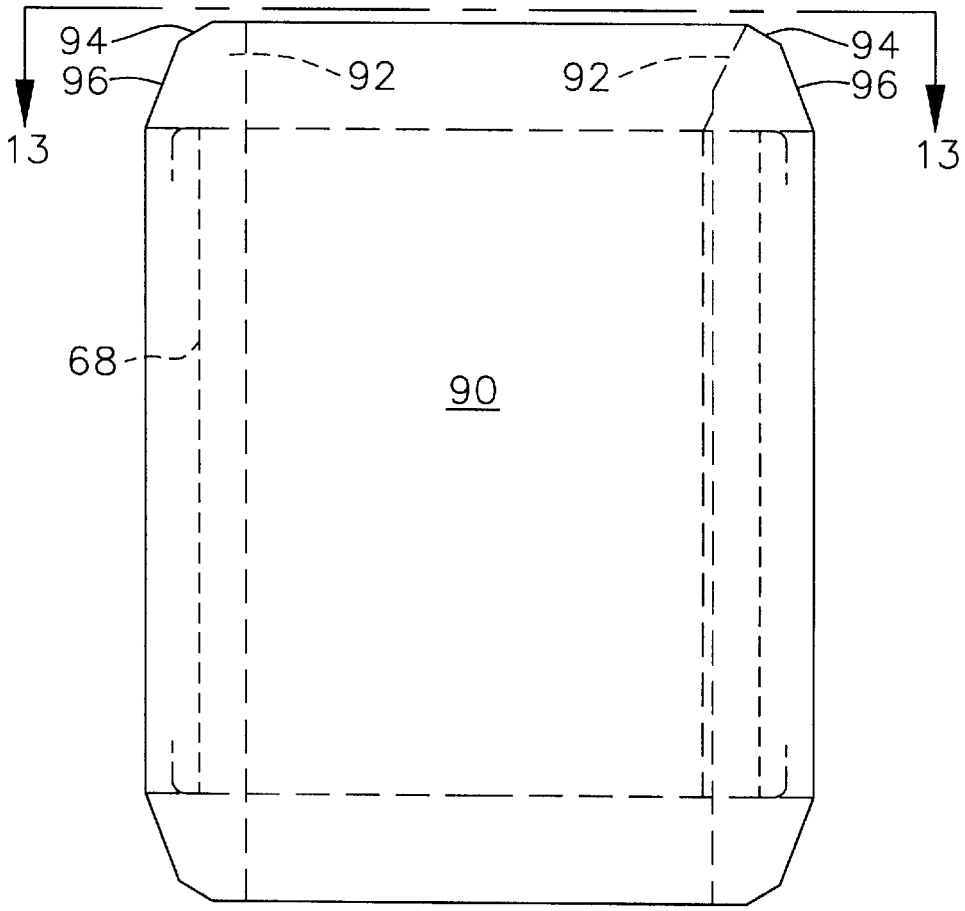
FIG. 12 is a schematic side elevation view showing an alternative form of the protector sleeve having a tapered internal surface that compensates for large loads.
Figure 13:
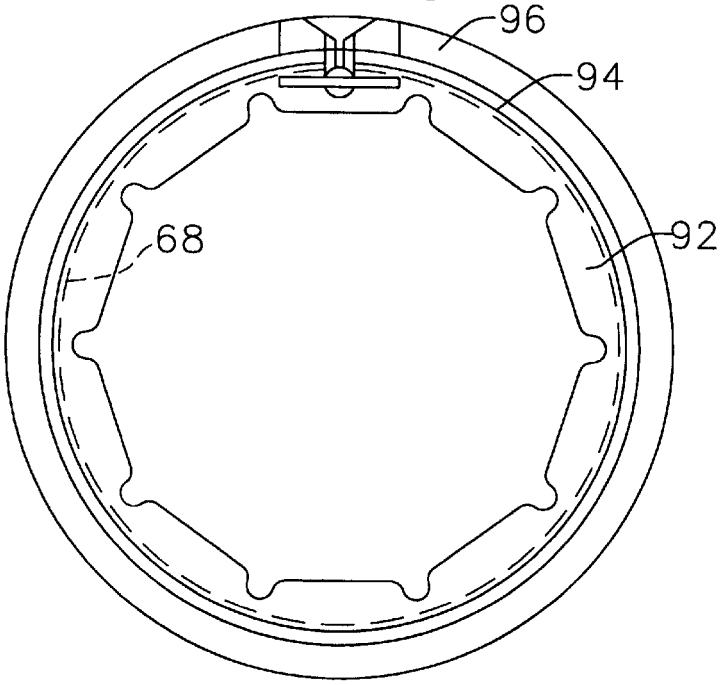
FIG. 13 is a top view taken on line 13—13 of FIG. 12.

FIGS. 12 and 13 show an alternate embodiment of a drill pipe protector sleeve 90 in which the ends of the sleeve have an annular taper 92 incorporated into the I.D. near the top and bottom ends of the sleeve. The taper 92 is on a relatively steep slope and is continuous and of uniform depth around the circumference of the sleeve. The taper at its top merges with the inside of an annular top edge 94 of the sleeve having a shallow downward slope toward the outside of the sleeve. An upwardly and inwardly tapered annular outer edge 96 extends around the top edge of the sleeve below the top edge 94. The bottoms of the tapered edges 92 and 96 are at about the same level spaced from the end of the sleeve.

The geometry of the taper is determined by the relationship of the elastomeric properties of the sleeve, the relative proximity of the cage 68 to the end of the sleeve, the Poisson's ratio of the sleeve material, and the magnitude of the applied loads. In general, the preferred length of the taper is 2–4 times the depth of the taper, hence a Taper Ratio is defined as the length of the taper divided by the depth of the taper, and the ratio is in the range from about two to about four.

Taper ratios greater than four tend to reduce the amount of effective surface for the hydraulic bearing; taper ratios less than two are typically insufficient for high contact loads (2000 lb. and greater normal contact loads).

The taper can be placed on either or both ends of the sleeve. If the taper is placed on both ends of the sleeve, the sleeve can be reversed and effectively double the useful life of the sleeve.

During use, the inside taper 92 prevents large side loading from forcing the end of the sleeve into abrading contact with the drill pipe. The tapered sleeve of this invention deflects inwardly to a neutral position without machining away the pipe.

The benefits of this embodiment are reduction or elimination of scouring of the drill pipe by the protector sleeve at high contact loads, and increased sleeve life because of reduced wear on the I.D. The invention is particularly useful in combination with the improved reinforcing cage structure of FIGS. 8 and 9. For rubber sleeves the improved cage holds the protector on the drill pipe more securely which can increase the abrasion wear if the end configuration of the protector results in deflection toward the pipe from side loads. The improved taper reduces or prevents such damage to the reinforced rubber protector.

Sliding Friction End Bearing Improvements

The '297 patent discloses a hydraulic bearing that reduces drill string torque and prevents casing wear. The protector sleeve in the '297 patent can be made of a pour-molded polymer (typical polyurethane). This material has a coefficient of friction of approximately 0.2 and greater against steel casing in the presence of various drilling muds, and 0.3 and greater against rock formations. With the use of large numbers of protectors on a drill string, the resistance of the protector sleeve to sliding down the hole may increase. The same problem occurs with pulling the pipe out of the hole.

To overcome any resistance to "sliding" it is desirable to use materials with lower coefficients of friction. However, protector sleeves operate in harsh environments with temperatures in excess of 300° F. and pressures in excess of 10,000 psi, thus precluding use of many low friction materials. These harsh environments suggest the need for specialized high temperature materials having low coefficients of friction. However, many specialized high temperature materials are very expensive, difficult to machine, and insufficiently flexible for the existing design.

A second problem with the rotator sleeve of the '297 patent is the wear on the ends of the sleeves. The '297 patent specifies the use of two collars or thrust bearings separated by a sleeve. The collars are rigidly attached to the rotating drill pipe; the sleeve floats on a hydraulic fluid layer between the pipe and the sleeve. As the collars rotate against the sleeve (typically not rotating and resting against the casing or formation), wear occurs. This wear tends to limit the life of the sleeve.

Figure 14:
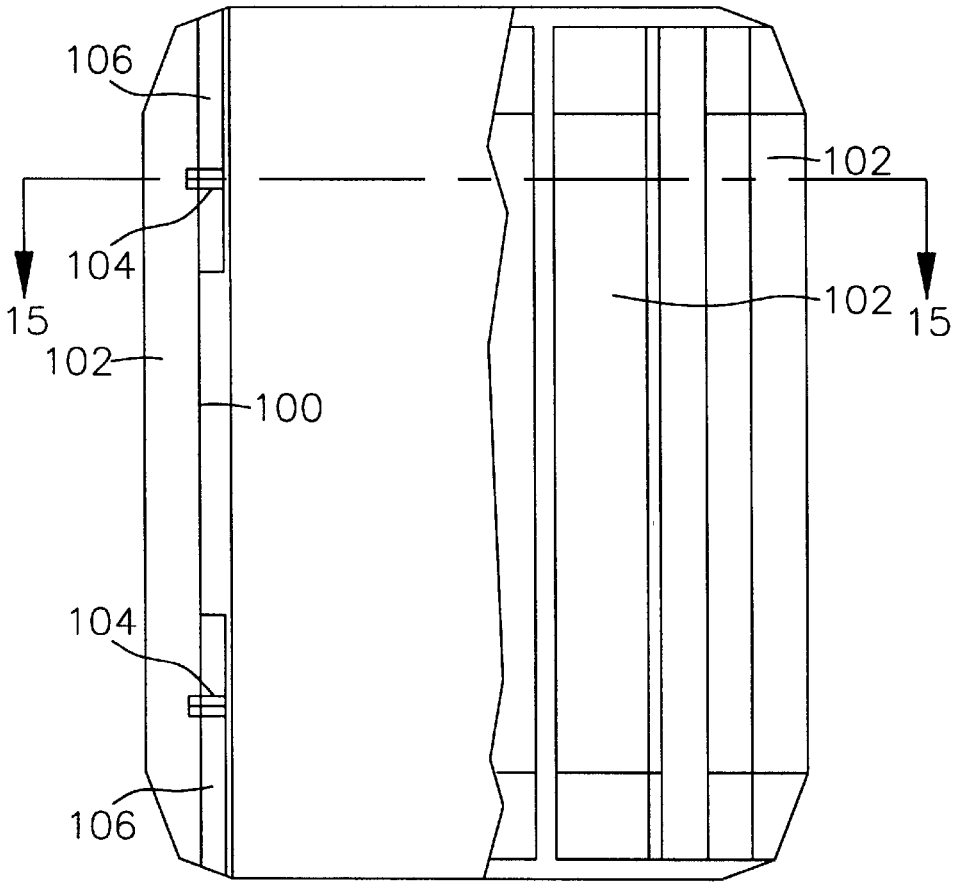
FIG. 14 is a schematic side elevation view partly broken away, showing an alternative form of the protector sleeve having sleeve inserts for reducing sliding friction.
Figure 15:
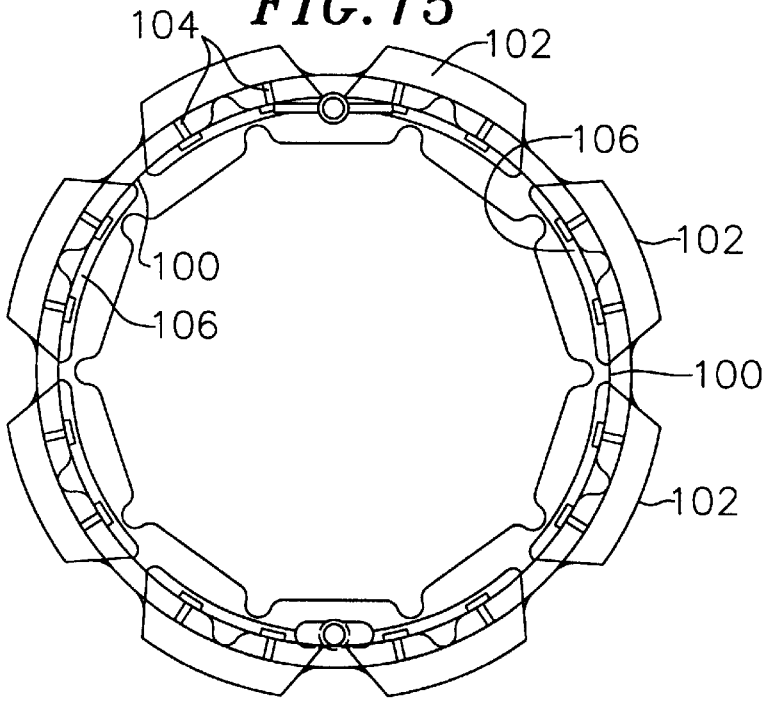
FIG. 15 is a cross-sectional view taken on line 15—15 of FIG. 14.

FIGS. 14 and 15 schematically illustrate a drill pipe protector sleeve that reduces the sliding friction of the sleeve. The schematic cross-sectional view of FIG. 14 shows the protector wall, a cylindrical metal cage 100 embedded in the sleeve wall, and runners 102 of a low coefficient of friction material. The runners are elongated parallel ribs spaced apart uniformly around the periphery of the sleeve. The runners are bolted, screwed or in some fashion attached to the cage 100 by fasteners 104 to allow proper positioning for the pouring of polyurethane around the runner inserts. The manufacturing procedure attaches the runners to the cage, placing the cage in the mold, pouring the urethane around the runner inserts, and curing the plastic, rubber or other composites.

The runners are made of a specially selected material having a low coefficient of friction, good abrasion resistance, and good temperature stability. An example of an acceptable material is a Teflon-graphite composite. This material has the appropriate coefficient of friction and temperature resistance. However, this composite material is also difficult to machine, extremely stiff, and expensive. To compensate for the material and cost limitations, the low coefficient of friction material is cut into long blocks or ribs that are used only on the exterior sliding surfaces on the sleeve. This circumvents manufacturing problems and minimizes cost. The low coefficient of friction runners have a recess in the base to allow infiltration through the urethane and to the low coefficient of friction material, thus improving attachment and preventing delamination between the blocks and the urethane body.

In addition, this improvement retains the inherent flexibility of the sleeve. Limited flexibility is beneficial because it allows the protector sleeve to tolerate impact loads from jarring and other externally applied impact. This design also reduces the coefficient of friction by approximately 65%, preserves existing manufacturing methods, and maintains existing sleeve flexibility, with only moderate cost increase.

The benefits of using this improvement are: (1) reduced sliding friction of the sleeve down and up the hole; (2) minimum impact to existing manufacturing methods; and (3) use of several materials, allowing minimization of overall product cost.

The improvement of FIGS. 14 and 15 increases the wear life of the sleeve by the addition of wear pads 106 at the ends of the sleeves. The wear pads, are attached to the cage 100 by the bolts or screws 104. The wear pads face the collars during use and are aligned at the same angle as the collar. The manufacturing process includes attaching the wear pads to the cage, placing the cage with wear pads in the molds, pouring the polymer around the cage assembly, and curing the sleeve material.

The wear pads are made of an abrasion-resistant material such as a graphite, a Kevlar composite, a hard bronze (if the collars are aluminum), or brake pad material. A variation of this concept allows the wear pads to be placed on the ends of the collars, producing a wear pad to wear pad contact. This improves the useful life of both the sleeves and the collars.

With the use of the alternate materials as designed, the working life of the sleeves and collars is extended, resulting in lower overall production cost.

The end bearing improvements are: (1) increased sleeve life, (2) minimum impact to existing manufacturing methods, and (3) use of several materials, allowing minimization of overall product cost.

Improved Drill Pipe Protector for Open-Hole Applications

Non-rotating drill pipe protectors can be used either in cased or open hole applications. Both uses offer the benefit of reduced drill string torque. For cased hole designs, the use of a non-rotating protector sleeve also can prevent excessive casing wear by the tool joints. In open hole applications, the sleeve must be able to withstand the difficult environment of intimate contact with the formation while reducing torque. Torque reduction is produced by the hydraulic fluid bearing on the interior of the protector sleeve, as described above, in which the drill pipe protector sleeve is retained between the two collars. In previous designs, sleeves were made from polymeric materials such as elastomers or polyurethane, and collars are typically made of aluminum.

As deviated holes increase in length or have more rapid departure rates from vertical, there is a greater need for an open hole protector that can reduce torque from the drilling string. For example, one need for this invention is for small diameter (for 2⅜ inch diameter drill pipe) in high angle (20 degrees per 100 feet) in West Texas. Another need is for a five-inch non-rotating sleeve for extended reach holes in the North Sea.

The disadvantage of using sleeves made from polymers in open hole applications is the rapid abrading of the sleeve O.D. as the drill pipe progresses down the hole. However, an advantage of the polymeric sleeve is that it allows a soft sacrificial "bearing" surface at the interface of the sleeve and the collar, thus causing minimal friction between the collar and sleeve. In open hole applications of the sleeve, the primary failure mode is abrading of the O.D. of the sleeve; the secondary failure mode is the abrading of the ends of the sleeves at the interface of the sleeve and the collar.

It is therefore desirable to improve the protector sleeve with modifications that both increase the resistance of the sleeve's O.D. to abrasion and also increase resistance of the ends of the sleeve to abrasion.

Figure 16:
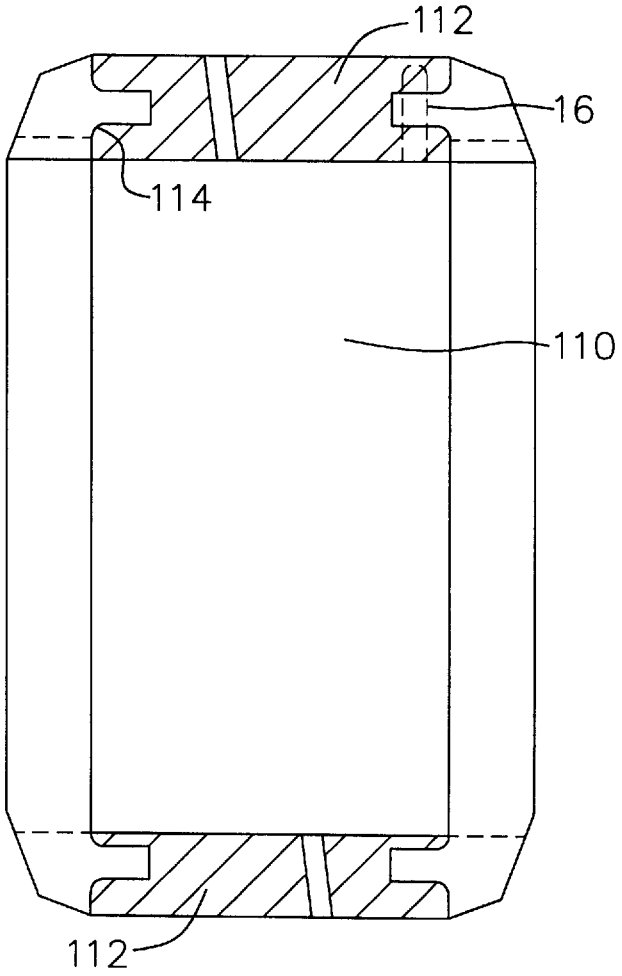
FIG. 16 is a schematic partial side elevation view showing an alternative form of the protector sleeve for open hole applications.

FIG. 16 shows such an improved sleeve 110 in which the sleeve body is made of aluminum or other suitable metal. This design provides good resistance of the sleeve O.D. to abrasion. The ends of the sleeve have annular bearing pads 112 which can be made of various abrasion-resistant materials. The preferred bearing pads are made of a tough fiber-plastic or fiber-epoxy composite. Alternatively, the bearing pads can be made of bronze or a similar metal. The advantage of a hardened bronze is that the wear life of the bearing pad is greater than that of composites. However, the coefficient of friction between the aluminum collars and a bronze bearing pad tends to be greater than that of aluminum and composite bearing pads. The higher coefficient of friction with the bronze pads can be partially compensated for with better lubrication of the surface by the drilling mud.

The bearing pads 112 have an annular recessed O.D. region 114 for allowing the bearing pads to be placed into machined slots and held in place with recessed screws 116. This allows the bearing pads to be replaced on an aluminum sleeve body. This also allows multiple uses of the same sleeve by replacing the end bearing pads.

The profile geometry of the bearing pad ends can be made to conform to the geometry of the protector sleeves described above.

Testing of a sleeve with composite bearing pads shows that pad wear patterns were consistent with those experienced in standard configurations. The ends of the sleeves showed material loss because of abrading on the bearing pads, as expected. Testing also showed that the aluminum sleeve body showed slight wear such as external scratches on the O.D. of the pad, but such wear was completely capable of being refurbished without machining.

The benefits of this design are: (1) increased abrasion resistance of the O.D. of open hole protectors, allowing greater sleeve life and greater potential for economical refurbishment, and (2) increased abrasion resistance of the bearing pads of the ends of the protectors, resulting in longer useful life of the protectors.

Improvements in Non-Rotating Drill Pipe Protector Collars

A problem that can occur with the drilling of deviated holes and using large numbers of drill pipe protectors is difficulty in the efficient return of drilling mud. A purpose of the drilling fluid is to carry rock cuttings from the drill bit to the surface. If the returning drilling fluid encounters obstructions, excessive pressure and velocity loss may result in a tendency for the cuttings to settle out, reducing the hole cleaning efficiency of the drilling mud. These cuttings can then build up into "bridges" in the hole that can make tool removal difficult and proper hole cleaning inefficient.

Because the diameter of the drill pipe protector is greater than the drill pipe tool joints, the protector sleeve can inhibit the cleaning efficiency of the mud. However, methods that tend to accelerate the velocity of the drilling mud at or near the protector can reduce the tendency for the cuttings to settle out.

This invention provides an improvement for the drill pipe protector collars that reduces the tendency of rock cuttings to settle out at or near the protectors.

Figure 19:
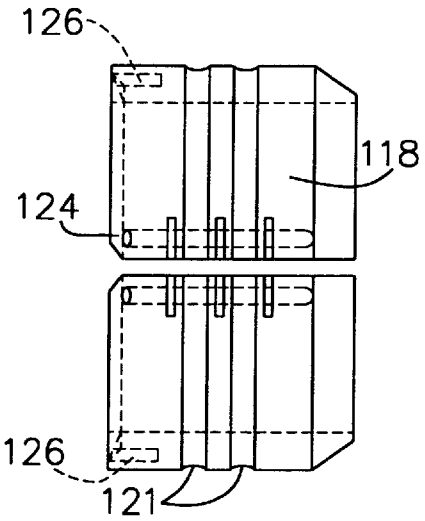
FIG. 19 is an opposite side view of the collar of FIG. 17.
Figure 18:
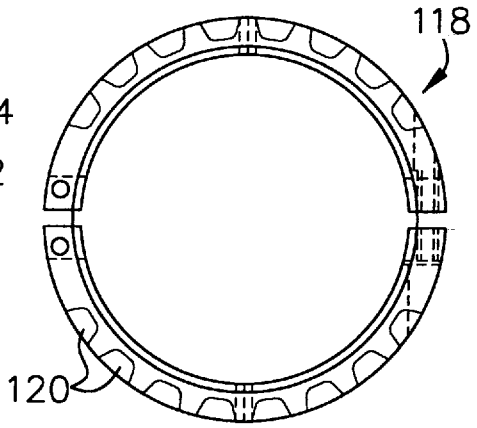
FIG. 18 is an end elevation view of the collar of FIG. 17.
Figure 17:
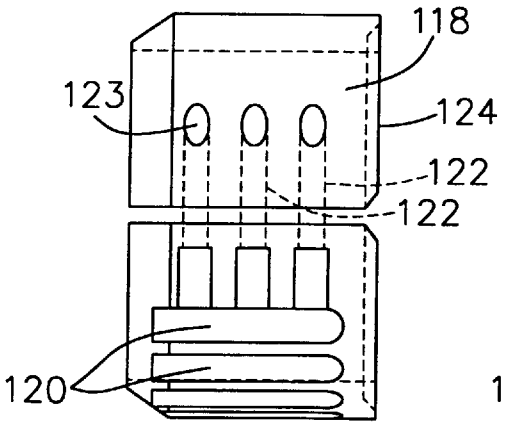
FIG. 17 is a schematic side elevation view showing an improved drill pipe protector collar.

FIGS. 17–19 show an improved drill pipe protector collar 118 which includes numerous exterior flutes 120 that are cut substantially the length of the collar O.D. The flutes are essentially trapezoidal in cross section (with rounded corners) and run longitudinally along the body of the collar. A preferred design is a flute that is approximately 3.5 inches long; the cross section of the flute is approximately 0.5 inches at its base nearest the I.D. of the collar and 0.75 inch at the O.D. of the collar. The corners of the trapezoid are rounded with a 0.050 inch radius. Alternately, the cross section can be semi-circular, ellipsoidal, spiral, helical or square in shape with approximately the same length and cross-sectional area. The individual flutes are separated by approximately 3/16 of an inch. The number of flutes is adjusted to be an integer number around the circumference of the collar. The preferred method of spacing of the flutes is to maintain the configuration (cross-sectional area and length) and modifying the spacing between flutes. A preferred configuration for a collar for a five-inch diameter drill pipe includes sixteen flutes, with eight flutes on either side of the split in the collar ring. The collar halves either can be attached by a hinge or they can be fastened by bolts, as in the illustrated embodiment of FIG. 18 in which screw threaded bores 122 receive bolts for fastening the collars to the pipe. The bolts can include a Helicoil 123 which is a thread locking device to prevent the bolts from backing out during operation. Flutes are not cut within the hinges or the attaching bolts.

When the improved collar is attached to a rotating drill pipe above and below the protector sleeve, the flutes act as blades of a rotating impeller. As mud rises past the rotating improved collar, the fluid tends to be pulled into the flutes. As the pipe rotates, the mud is sucked into the flutes and exits the end of the flutes. The mud then passes the body of the sleeve. Next the mud encounters the second fluted improved collar, and again is accelerated by the impeller effect of the second flutes. The result of passing the two improved fluted collars is a net acceleration of the drilling mud near the drill pipe protector sleeve.

A benefit from using the improved impeller collar is that the fluted collars produce a net drilling fluid velocity increase, thus preventing the settling out of rock cuttings at or near the drill pipe protector sleeve. Alternatively, circumferential grooves 121 (see FIG. 19) can be positioned in the O.D. of the collars to allow some flexing of the collars when installed on the drill pipe.

Drill Pipe Protector Collars With Wear Surfaces

The drill pipe protector stop collars installed above and below the protector sleeve can have removable annular wear plates of a hard protective material that resists abrasion from contact with the protector sleeve. The wear plates 124 are illustrated at the ends of the collar shown in FIGS. 18 and 19. The wear plates are preferably made from graphite, a Kevlar composite, a hard bronze, or other wear-resistant material having a hardness and abrasion resistance greater than the aluminum body of the collar. The wear plates are fastened to the collar body by spaced apart screws 126 so that wear plate can be removed and replaced to extend the useful life of the collar.

Installation of Multiple Drill Pipe Protector Sleeves

Figure 20:
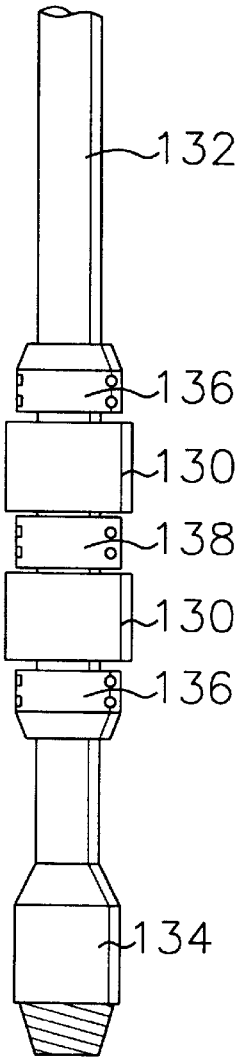
FIG. 20 is a schematic side elevation view showing a first configuration of a drill pipe using the improved drill pipe protector collar.
Figure 21:
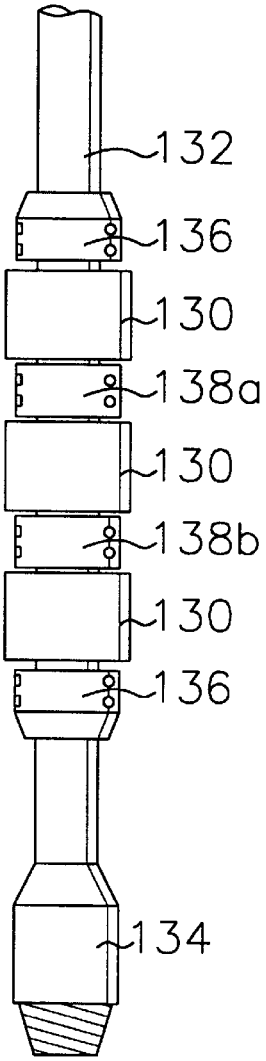
FIG. 21 is a schematic side elevation view showing a second configuration of a drill pipe using the improved drill pipe protector collar.
Figure 22:
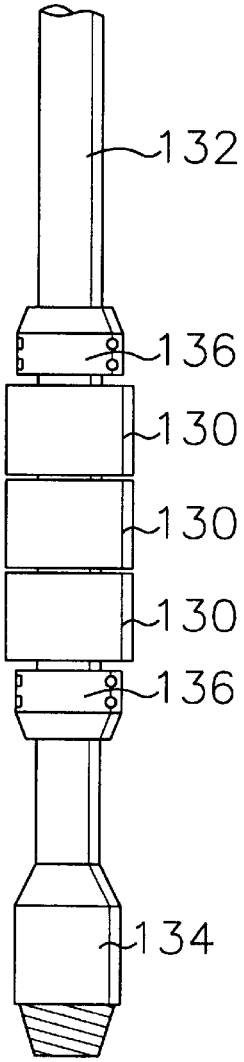
FIG. 22 is a schematic side elevation showing a third configuration of a drill pipe using multiple drill pipe protectors.

There are instances in which it may be desirable to lengthen the area of protection along a rotating drill pipe. Large side loads may require the use of a number of protector sleeves in one region of the drill pipe, for example, FIGS. 20–22 illustrate various combinations of drill pipe protector sleeves 130 secured to a drill pipe 132 near the pin end of a tool joint 134. (Although the protectors are shown installed near the pin end of the tool joint, they can be installed in the same patterns anywhere along the length of the drill pipe.)

In the embodiment illustrated in FIG. 20, a pair of drill pipe protector sleeves 130 are installed on to drill pipe 132 between a pair of upper and lower drill pipe collars 136. A single intermediate drill pipe collar 138 is installed between the upper and lower protector sleeves, rather than using two separate standard drill pipe collars 136 in this area. The drill pipe protector sleeves can have any of the configurations described previously. The intermediate drill pipe collar 138 has opposite end configurations similar to the end bearing configurations (for interfacing the adjacent protector sleeves) of the drill pipe collars described previously.

FIG. 21 illustrates an installation pattern for these spaced apart drill pipe protector sleeves 130 in which a first intermediate collar 138*a* separates the upper and intermediate sleeves and a second intermediate collar 138*b* separates the intermediate and lower protector sleeves. Normal drill pipe collars 136 provide stops for the top and bottom sleeves, and have tapered ends which allow the protector assembly to be easily dragged past or across obstructions or ledges in the bore hole.

FIG. 22 is a further embodiment in which a group of three protector sleeves 130 are installed adjacent to each other on the drill pipe with the end restraints provided only by normal upper and lower drill pipe collars 136.

Use of Drill Pipe Protectors On Drill Collars in Open Hole Drilling

Normally when drilling an open hole in a formation, a group of drill collars are installed on the drill string immediately above the drill pipe and below a stabilizer and sub. When drilling a deviated hole or high angle hole, particularly in a horizontal direction, undesired differential pressure can build up and cause increased drag which can prevent further drilling down hole or prevent pulling the drill string out of the hole. The drill pipe protector sleeves of this invention can be installed in series in the area of the drill string termed the drill collars. Their greater radius can provide more contact area with the hole, equalize fluid pressure, and keep the collars off the bottom of the (horizontal) hole which can reduce sliding friction. The advantage of using the drill pipe protector sleeves in this area is that they can be installed without screw threads anywhere on the pipe to prevent differential pressure in a given region. The protector sleeves made of metal are used in this application.

Figure 23:
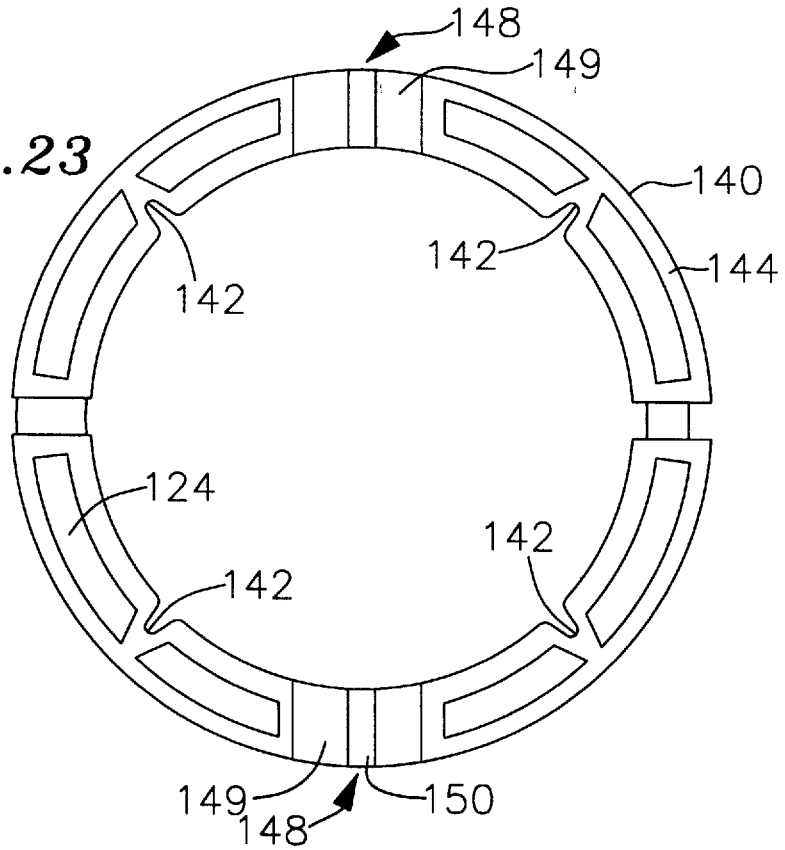
FIG. 23 is a top view of an alternative drill pipe protector collar.
Figure 24:
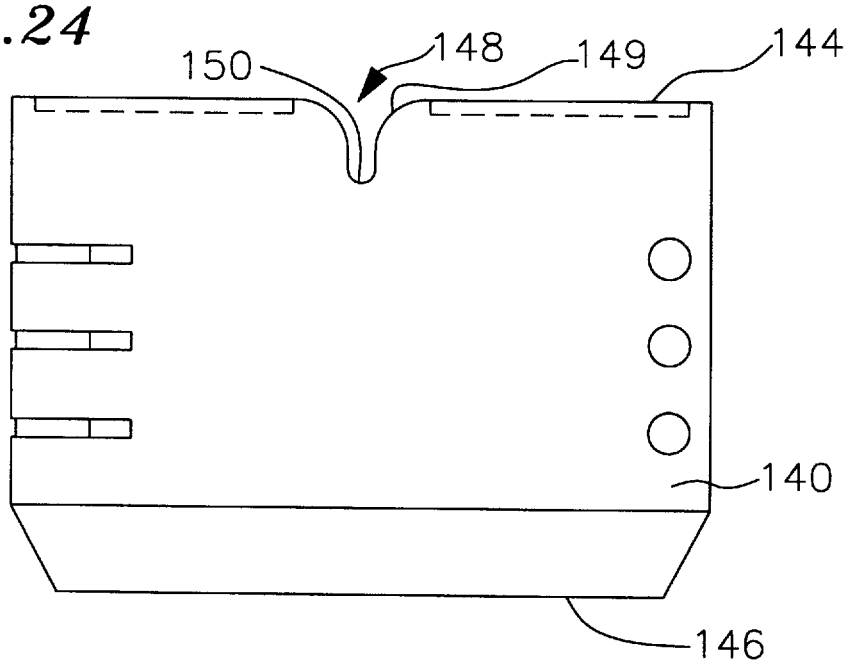
FIG. 24 is a side view of the drill pipe protector collar of FIG. 23.

An alternative drill pipe protector collar 140 is shown in FIGS. 23 and 24. In this embodiment the collar includes a plurality of elongated, longitudinally extending, straight, parallel axial grooves 142 spaced apart circumferentially around the I.D. of the collar. The grooves are preferably spaced uniformally around the I.D. of the collar, extend vertically, (i.e., at a right angle to the top and bottom annular ends of the collar) and are open ended in the sense that they open through an annular top end 144 and an annular bottom end 146 of the collar. The grooves 142 reduce circumferential stiffness of the collar and allow expansion and contraction of the collar I.D. in order to snugly fit variations in O.D. of drill pipes that are within API specifications. End slots 148 are formed in the annular top end wall 144 of the collar. The end slots have radially curved upper edges 149 which converge downwardly toward one another and open into a narrow generally U-shaped channel 150 at the bottom of each end slot.

Figure 25:
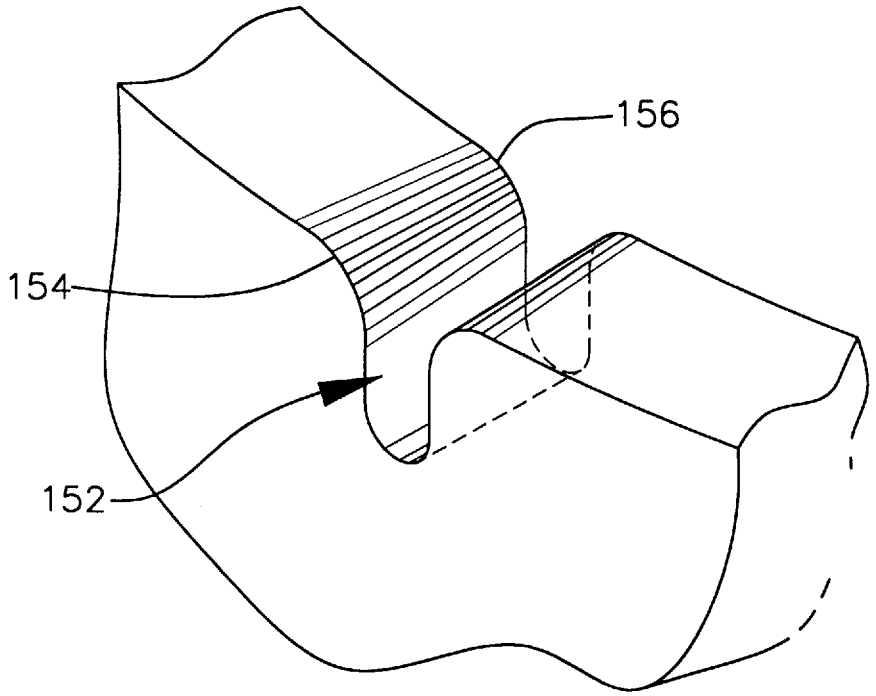
FIG. 25 is an enlarged perspective detail of an alternative end slot configuration of FIGS. 3 and 24.

FIG. 25 illustrates yet another embodiment for the end slot 148 of the present invention. The configuration for end slot 148 is equally applicable for end slots located in both the drill pipe protector sleeve and the associated collars. This embodiment includes varying the taper profile across the thickness of the sleeve and collar. The taper profile is modified from other embodiments by reducing the taper angle across the thickness of the sleeve in the collar when traversing across the thickness from the O.D. to the I.D. The purpose of altering the profile is to increase the efficiency of the developing fluid bearing at the top of the sleeve. This is accomplished by improving the pressure profile of the fluid bearing.

The pressure profile is established by the rotation of the collar attached to the drill pipe relative to the sleeve which is nearly motionless. Fluid moves from the annulus of the O.D. of the drill pipe and the I.D. of the sleeve to the top of the sleeve and collar interface. This drilling fluid then establishes a hydraulic bearing while lubricating the surfaces then moves radially toward the outside diameter of the sleeve and collar interface. Bearing lubrication and, consequently, the sleeve and collar life is improved if fluid is not squeezed from the collar and sleeve interface. If the fluid remains longer in the interface, high friction from non-lubricated surfaces is prevented. By varying the taper profile of the sleeve and collar interface to a less steep profile as traversing from the O.D. to the I.D., the vectorial sum of the fluid velocity moving across the surface is changed to a more circumferential flow. Greater circumferential flow allows for a more complete lubrication to be established on the circumference of the sleeve and collar interface.

In addition, the fluid's vectorial direction effects the development of the pressure profile and hence the hydraulic bearing efficiency. The vectorial direction of flow establishes the location of the pressure profile of the bearing. With the described profile, the maximum pressure tends to remain within the confines of the interface for greater distances. Without lubrication, dry spots are prevented and tool life is improved. As shown in FIG. 25, the profile of the end groove 152 includes a tapered shape which is circumferentially angled from the O.D. 154 towards the I.D. 156 resulting in a variable tapered wedge at the beginning of the fluid bearing. By incorporating this slanted design on both ends of the drill pipe protector allows the sleeve to be inverted without loss of the benefits of the improved interface hydraulic bearing. The preferred taper angle is about 50 from the O.D. to the I.D. of the sleeve and collar.

What is claimed is:

1. An underground drilling system comprising:

a well bore in an underground formation;

a fixed tubular casing installed in the well bore;

a rotary drill pipe extending through the casing and having an O.D. spaced from an I.D. of the casing or well bore during normal drilling operations;

a protective sleeve mounted around the drill pipe and spaced from the I.D. of the casing or bore for preferentially contacting the I.D. of the casing or bore when the drill pipe deflects off-center in the casing or bore to protect the casing or bore from contact with the drill pipe or its tool joints during rotation of the drill pipe;

thrust bearing means rigidly affixed to the drill pipe above and below the sleeve for retaining the sleeve in a fixed axial position on the drill pipe;

the protective sleeve mounted to the drill pipe via an internal sleeve I.D. configuration that substantially reduces the rotational rate of the sleeve upon frictional contact of the sleeve with the I.D. of the casing or bore, while allowing the rotary drill pipe to continue rotating within the sleeve at a rotation rate sufficient to conduct drilling operations in the formation; said internal configuration comprising longitudinally extending and circumferentially spaced apart axial grooves formed in an I.D. wall of the sleeve for allowing fluid to circulate through a space formed between the I.D. of the sleeve and the O.D. of the drill pipe; and non-tapered flat bearing surface regions of the I.D. wall of the sleeve extending between adjacent axial grooves and arranged in a polygon configuration contacting the O.D. of the drill pipe by tangential point contact around a portion of the sleeve I.D. for causing the sleeve to separate from the O.D. of the drill pipe upon circulation of a fluid film under pressure between the sleeve and drill pipe to produce a fluid bearing effect having reduced frictional drag.

2. The drilling system according to claim 1 in which the internal configuration further includes radially curved transition regions between the opposite ends of each flat bearing surface and the walls of the axial grooves adjacent the ends of each bearing surface.

3. The drilling system according to claim 2 in which the transition regions have a relatively larger radius of curvature than the radius of curvature of the adjacent groove.

4. The drilling system according to claim 1 in which the flat bearing surfaces on the I.D. of the sleeve to form a polygon having a number of bearing surfaces defined by the equation n=I.D.÷0.4, where I.D. equals the sleeve inside diameter in inches and n equals the number of sides of the polygon.

5. The drilling system according to claim 1 in which the sleeve has top and bottom annular ends with an angularly tapered outer wall section matching a tapered annular outer wall section of the corresponding end surface of the adjacent thrust bearings.

6. The drilling system according to claim 1 in which the protector sleeve is made of an elastomeric material, and including a generally cylindrical metal reinforcing cage embedded in a cylindrical wall of the elastomeric protector sleeve to reinforce the wall of the cylindrical axially, and transversely the sleeve wall having a pattern of holes through which the elastomeric material of the sleeve passes between opposite faces of the cylindrical reinforcing cage, and a flanged extension of the reinforcing cage projecting laterally away from and extending generally around the periphery of the reinforcing cage while embedded in the cylindrical wall, said flanged extension increasing the shear strength and resultant load capacity of the protector sleeve while improving resistance to delamination between the cage and the sleeve elastomeric material.

7. The drilling system according to claim 6 in which the extension projects from both ends of the cylindrical cage.

8. The drilling system according to claim 7 in which the extension comprises and annular lip extending substantially at a 90° to 180° angle around the cage.

9. The drilling system according to claim 6 in which an annular end section of the protector sleeve has a tapered end configuration for compensating for large applied loads to the sleeve, the tapered end configuration including an annular tapered outer surface tapering inwardly toward the rotational axis of the sleeve in a direction extending toward the sleeve end, and an annular tapered inner surface tapering outwardly away from the rotational axis of the sleeve in a direction toward the sleeve end, said annular end section of the elastomeric sleeve being capable of deflecting inwardly under applied side loads to a neutral position without applying abrasion damage to the adjacent drill pipe.

10. The drilling system according to claim 1 in which an annular end section of the protector sleeve has a tapered end configuration for compensating for large applied loads to the sleeve, the tapered end configuration including an annular tapered outer surface tapering inwardly toward the rotational axis of the sleeve in a direction extending toward the sleeve end, and an annular tapered inner surface tapering outwardly away from the rotational axis of the sleeve in a direction toward the sleeve end, said annular end section of the elastomeric sleeve being capable of deflecting inwardly under applied side loads to a neutral position without applying abrasion damage to the adjacent drill pipe.

11. The drilling system according to claim 1 in which the sleeve is a cylindrical reinforcing cage embedded in a wall of the protector sleeve to reinforce its strength, and further including spaced-apart wear pads rigidly affixed to the reinforcing cage, the wear pads comprising a material having an abrasion resistance greater than the sleeve, the wear pads embedded in and extending through the wall of the sleeve to the vicinity of an annular end of the sleeve adjacent the thrust bearing to a position in which the wear pads preferentially receive wear from applied loads and thereby extend the working life of the sleeve.

12. The drilling system according to claim 1 in which the protective sleeve is made from an elastomeric material, and including a cylindrical reinforcing cage embedded in a wall of the protector sleeve to provide reinforcement to improve the load strength of the elastomeric material, and including low-friction, narrow, axially extending runners circumferentially spaced apart and extending lengthwise generally parallel to one another around the outer periphery of the cylindrical sleeve, and fastening means rigidly securing the runners to the reinforcing cage structure, the low-friction runners reducing sliding friction of the sleeve.

13. The drilling system according to claim 1 in which the protector sleeve includes circumferentially spaced-apart grooves facing outwardly and forming flow channels over an annular end of the sleeve, and intervening low-pressure suction reservoirs formed as relief areas and spaced between the flow channels to improve the fluid bearing effect at the end of the sleeve adjacent the thrust bearing means.

14. The drilling system according to claim 1 in which the sleeve is made of an elastomeric material, and the sleeve has an annular end, and further including an annular wear plate removably secured over the annular end of the elastomeric sleeve, the wear plate having a hardness and abrasion resistance greater than the elastomeric material of the sleeve and means releasably fastening the wear plate to the annular end of the sleeve for removability and replacement.

15. The drilling system of claim 1 wherein the thrust bearing means are collars having a plurality of circumferentially spaced flutes on the O.D. of the collar for accelerating drilling mud near the protective sleeve.

16. The drilling system of claim 1 wherein the thrust bearing means are collars having at least one circumferential groove around the O.D. of the collar allowing flexibility of the collar during installation on the drill pipe.

17. The drilling system of claim 1 wherein the thrust bearing means are collars having a plurality of axially extending grooves on the I.D. of the collar allowing flexibility of the collar during installation on the drill pipe.

18. The drilling system of claim 17 wherein said collars include bolt locking means to secure the collar to the drill-pipe.

19. The drilling system of claim 17 wherein the collars include at least one end slot formed in an annular top end wall of the collar.

20. The drilling system of claim 19 wherein the end slot has a taper profile which varies in thickness from the O.D. to the I.D. of the collar.

21. The drilling system of claim 19 wherein the collars include wear plates positioned on the annular top end wall.

22. The drilling system of claim 1 further comprising a thin-walled tubular sleeve liner positioned between the protective sleeve and the drill pipe.

23. The drilling system of claim 1 wherein a plurality of protective sleeves are mounted around the drill pipe, the sleeves are separated by an intermediate thrust bearing.

24. For use inside a bore in an underground formation or in a tubular casing installed in the formation, in which a rotary drill pipe extends through the bore or the casing so the drill pipe is surrounded by a wall surface of the bore or casing, a drill pipe protector assembly comprising:

a protective sleeve secured to an exterior surface of the drill pipe, the sleeve having an outside diameter larger than the outside diameter of the drill pipe and substantially less than the inside diameter of said wall surface to provide protection for said wall surface and for the drill pipe upon contact between an outside surface of the sleeve and the wall surface caused by the drill pipe deflecting off-center in said casing or bore;

fluid bearing means between an inside face of the sleeve and the outside of the drill pipe for causing the sleeve to rotate with the rotary drill pipe during normal rotary drilling operations in which there is an absence of contact between the sleeve and the wall surface, the fluid bearing means causing the sleeve to undergo a substantial reduction in its rate of rotation relative to the drill pipe while allowing the drill pipe to continue rotating relative to the sleeve upon frictional contact between the outside surface of the sleeve and said wall surface; and thrust bearing means rigidly affixed to the drill pipe above and below the sleeve for maintaining the sleeve in a fixed axial position on the rotary drill pipe during rotation of the drill pipe and sleeve and during contact of the sleeve with said wall surface;

in which the fluid bearing means include circumferentially spaced apart axial grooves extending along the inside face of the sleeve, the inside face of the sleeve further having circumferentially spaced apart non-tapered flat bearing surfaces extending between adjacent axial grooves for contact with the outside of the drill pipe, the bearing surfaces being arranged in a polygon configuration for confronting and contacting the outside of the drill pipe tangentially around a portion of the circumference of the sleeve;

the sleeve further comprising circumferentially spaced apart recessed end slots in an annular end wall of the sleeve, the thrust bearings and the fluid bearing means of the sleeve causing fluid from outside the drill pipe to circulate through the axial grooves to an annular space between the flat bearing surfaces and the drill pipe for slightly separating the inside face of the sleeve from the outside of the drill pipe by producing a film of lubricating and supporting fluid at the interface between the drill pipe and said bearing surfaces, said film of lubricating and supporting fluid having an enhanced fluid bearing effect caused by said end slots tending to reduce the effects of torque or drag acting on the drill pipe when the sleeve contacts said wall surface.

25. Apparatus according to claim 15 in which the number of polygon-shaped bearing surfaces on the I.D. of the sleeve is at least twice the I.D. of the sleeve measured in inches.

26. Apparatus according to claim 24 in which the axial grooves are substantially uniformly spaced apart around the inside face of the sleeve so the intervening bearing surfaces are each approximately the same length between adjacent grooves.

27. Apparatus according to claim 24 in which the O.D. of the sleeve has elongated circumferentially spaced apart axial flutes aligned with and opening into the recessed end slots.

28. Apparatus according to claim 27 in which the number of polygon-shaped bearing surfaces on the I.D. of the sleeve is the same as or exceeds the number of flutes on the O.D.

29. A protective sleeve for installation around a drill pipe used to drill a well bore in an underground formation, the protective sleeve preferentially contacting the I.D. of a well casing or bore when the drill pipe deflects off center in the casing or bore to protect the casing or bore from contact with the drill pipe or its tool joints during rotation of the drill pipe, in which the protective sleeve has a generally cylindrical configuration with an internal I.D. for contact with the O.D. of the drill pipe, in which the protector sleeve is made of an elastomeric material and including a generally cylindrical metal reinforcing cage embedded in a cylindrical wall of the elastomeric protector sleeve to reinforce the wall of the cylindrical axially, the sleeve wall having a pattern of holes through which the elastomeric material of the sleeve wall passes between opposite faces of the cylindrical reinforcing cage, and a curved flanged extension of the reinforcing cage projecting laterally away from and extending generally around the periphery of the reinforcing cage wall structure while embedded in the cylindrical, said curved flanged extension increasing the shear strength and resultant load capacity of the protector sleeve while improving resistance to delamination between the cage and the sleeve elastomeric material.

30. The drilling system according to claim 29 in which the extension projects from both ends of the cylindrical cage.

31. The drilling system according to claim 29 in which the extension comprises an annular lip extending substantially at a 90° to 180° angle around the cage.

32. A protective sleeve for installation around a drill pipe used to drill a well bore in an underground formation, the protective sleeve preferentially contacting the I.D. of a well casing or bore when the drill pipe deflects off center in the casing or bore to protect the casing or bore from contact with the drill pipe or its tool joints during rotation of the drill pipe, in which the protective sleeve has a generally cylindrical configuration with an internal I.D. for contact with the O.D. of the drill pipe, in which the protector sleeve is made of an elastomeric material and including a generally cylindrical metal reinforcing cage embedded in a cylindrical wall of the elastomeric protector sleeve to reinforce the wall of the sleeve axially, the cylindrical wall having a pattern of holes through which the elastomeric material of the sleeve passes between opposite faces of the cylindrical reinforcing cage, and a curved flanged extension of the reinforcing cage projecting laterally away from and extending generally around the periphery of the reinforcing cage, said flanged extension increasing the shear strength and resultant load capacity of the protector sleeve while improving resistance to delamination between the cage and the sleeve elastomeric material in which an annular end section of the protector sleeve has a tapered end configuration for compensating for large applied loads to the sleeve, the tapered end configuration including an annular tapered outer surface tapering inwardly toward the rotational axis of the sleeve in a direction extending toward the sleeve end, and an annular tapered inner surface tapering outwardly away from the rotational axis of the sleeve in a direction toward the sleeve end, said annular end section of the elastomeric sleeve being capable of deflecting inwardly under applied side loads to a neutral position without applying abrasion damage to the adjacent drill pipe.

33. A protective sleeve for installation around a drill pipe used to drill a well bore in an underground formation, the protective sleeve preferentially contacting the I.D. of a well casing or bore when the drill pipe deflects off center in the casing or bore to protect the casing or bore from contact with the drill pipe or its tool joints during rotation of the drill pipe, in which the protective sleeve has a generally cylindrical configuration with an internal I.D. for contact with the O.D. of the drill pipe in which an annular end section of the protector sleeve has a tapered end configuration for compensating for large applied loads to the sleeve, the tapered end configuration including an annular tapered outer surface tapering inwardly toward the rotational axis of the sleeve in a direction extending toward the sleeve end, and an annular tapered inner surface tapering outwardly away from the rotational axis of the sleeve in a direction toward the sleeve end, said annular end section of the elastomeric sleeve being capable of deflecting inwardly under applied side loads to a neutral position without applying abrasion damage to the adjacent drill pipe.

34. A protective sleeve for installation around a drill pipe used to drill a well bore in an underground formation, the protective sleeve preferentially contacting the I.D. of a well casing or bore when the drill pipe deflects off center in the casing or bore to protect the casing or bore from contact with the drill pipe or its tool joints during rotation of the drill pipe, in which the sleeve includes a cylindrical reinforcing cage embedded in a wall of the protector sleeve to reinforce its strength and including spaced-apart wear pads rigidly cage, the wear pads comprising a material having an abrasion resistance greater than the sleeve, the wear pads embedded in the elastomeric material of the sleeve and extending through the cylindrical wall of the elastomeric sleeve to the vicinity of an annular end of the sleeve to a position in which the wear pads preferentially receive wear from applied loads and thereby extend the working life of the sleeve.

35. A protective sleeve for installation around a drill pipe used to drill a well bore in an underground formation, the protective sleeve preferentially contacting the I.D. of a well casing or bore when the drill pipe deflects off center in the casing or bore to protect the casing or bore from contact with the drill pipe or its tool joints during rotation of the drill pipe, in which the protective sleeve is made from an elastomeric material, and including a cylindrical reinforcing cage embedded in a wall of the protector sleeve to provide reinforcement to improve the load strength of the elastomeric sleeve material, and including low-friction, narrow, axially extending runners circumferentially spaced apart and extending lengthwise generally parallel to one another around the outer periphery of the cylindrical sleeve, and fastening means rigidly securing the runners to the reinforcing cage structure, the low-friction runners reducing sliding friction of the sleeve.

36. A protective sleeve for installation around a drill pipe used to drill a well bore in an underground formation, the protective sleeve preferentially contacting the I.D. of a well casing or bore when the drill pipe deflects off center in the casing or bore to protect the casing or bore from contact with the drill pipe or its tool joints during rotation of the drill pipe, in which the protector sleeve includes circumferentially spaced-apart grooves facing outwardly and forming flow channels over an annular end of the sleeve, and intervening low-pressure suction reservoirs formed as relief areas and spaced between the flow channels to improve the fluid bearing effect at the end of the sleeve adjacent a collar retained on the drill pipe as a fixed thrust bearing to resist the axial movement of the sleeve along the drill pipe.

37. A protective sleeve for installation around a drill pipe used to drill a well bore in an underground formation, the protective sleeve preferentially contacting the I.D. of a well casing or bore when the drill pipe deflects off center in the casing or bore to protect the casing or bore from contact with the drill pipe or its tool joints during rotation of the drill pipe, in which the sleeve is made of a polymeric material and the sleeve has an annular end and further including an annular wear plate removably secured over the annular end of the elastomeric sleeve, the wear plate having a hardness and abrasion resistance greater than the polymeric material of the sleeve, and means releasably fastening the wear plate to the annular end of the sleeve for removability and replacement.

38. A protective sleeve for installation around a drill pipe used to drill a well bore in an underground formation, the protective sleeve contacting the I.D. of the well bore when the drill pipe deflects off center in the bore to protect the bore from contact with the drill pipe or its tool joints during rotation of the drill pipe, in which the sleeve is made of metal and the sleeve has replaceable annular bearing pads made of abrasion resistant material located at and secured to each end of the sleeve.

* * * * *

UNITED STATES PATENT AND TRADEMARK OFFICE

CERTIFICATE OF CORRECTION

PATENT NO. : 5,803,193
DATED : September 8, 1998
INVENTOR(S) : R. Ernst Krueger; N. Bruce Moore

It is certified that error appears in the above-identified patent and that said Letters Patent is hereby corrected as shown below:

Column 1, lines 61,62, change "time. These" to -- time, these --.
Column 2, line 5, change "frictionally-developed" to --frictionally developed --.
Column 4, line 39, after "elevation" insert -- view --.
Column 7, line 61, replace "configuration such similar configuration are" with -- configuration and such similar configurations are --.
Column 7, line 67, change "materials" to -- material --.
Column 9, line 49, after "surface 50" insert -- is --.
Column 10, line 2, change "inches" to -- inch --.
Column 10, line 33, change "inches" to -- inch --.
Column 13, line 53, change "re- installing" to -- reinstalling --.
Column 15, line 23, change "typical" to -- typically --.
Column 19, line 8, change "on to" to -- onto --.
Column 19, line 55, change "uniformally" to -- uniformly --.
Column 20, line 46, change "50" to -- 5° --.
Column 21, line 28, after "sleeve" delete "to".
Column 21,lines 39,41,50, change "protector" to -- protective -- (all ocurrences).
Column 21, line 42, replace "cylindrical axially" with -- sleeve axially --.
Column 21, line 43, replace "sleeve wall" with -- cylindrical wall --.
Column 21, line 56, change "and annular" to -- an annular --.
Column 21, line 59, change "protector" to -- protective --.
Column 22, line 4, change "protector" to -- protective --.
Column 22, line 12, before "sleeve" delete -- elastomeric --.
Column 22, line 15, replace "sleeve is" with -- sleeve includes --.
Column 22, line 16, change "protector" to -- protective --.

UNITED STATES PATENT AND TRADEMARK OFFICE

CERTIFICATE OF CORRECTION

PATENT NO. : 5,803,193
DATED : September 8, 1998
INVENTOR(S) : R. Ernst Krueger; N. Bruce Moore It is certified that error appears in the above-identified patent and that said Letters Patent is hereby corrected as shown below:

Column 22, line 28, change "protector" to -- protective --.
Column 22, line 36, change "protector" to -- protective --.
Column 23, line 9, after "plurality of" insert -- the --.
Column 23, line 10, after "pipe," insert -- and --.
Column 23, line 12, replace "For use" with -- Apparatus for use --.
Column 24, lines 20,23,32, change "protector" to -- protective -- (all occurrences).
Column 24, lines 48,51,59,61, change "protector" to -- protective -- (all occurrences).
Column 25, line 15, change "protector" to -- protective --.
Column 25, line 22, before "sleeve" delete "elastomeric".
Column 25, line 33, change "protector" to -- protective --.
Column 25, line 34, after "rigidly" insert -- affixed to the reinforcing --.
Column 25, line 37, after "in the" delete "elastomeric material of the".
Column 25, line 38, after "through the" delete "cylindrical wall of the elastomeric".
Column 26, line 1, change "protector" to -- protective --.

UNITED STATES PATENT AND TRADEMARK OFFICE

CERTIFICATE OF CORRECTION

PATENT NO. : 5,803,193
DATED : September 8, 1998
INVENTOR(S) : R. Ernst Krueger; N. Bruce Moore It is certified that error appears in the above-identified patent and that said Letters Patent is hereby corrected as shown below:

Column 26, line 17, change "protector" to -- protective --.
Column 26, line 34, before "sleeve" delete "elastomeric".

Signed and Sealed this

Fourteenth Day of September, 1999

*Attest:*

Q. TODD DICKINSON

*Attesting Officer*

*Acting Commissioner of Patents and Trademarks*